US012612206B2

(12) United States Patent
Wetsch et al.

(10) Patent No.: US 12,612,206 B2
(45) Date of Patent: Apr. 28, 2026

(54) SYSTEMS FOR DISPENSING PILLOWS FOR PRODUCT PACKAGING

(71) Applicant: Pregis LLC, Chicago, IL (US)

(72) Inventors: Thomas D. Wetsch, Naples, FL (US); Ken Chess, Hinsdale, IL (US); Charles Anthony Daigle, El Dorado Hills, CA (US); David Schuda, Wheaton, IL (US)

(73) Assignee: Pregis LLC, Chicago, IL (US)

( * ) Notice: Subject to any disclaimer, the term of this patent is extended or adjusted under 35 U.S.C. 154(b) by 0 days.

(21) Appl. No.: 18/391,631

(22) Filed: Dec. 20, 2023

(65) Prior Publication Data

US 2024/0199261 A1 Jun. 20, 2024

Related U.S. Application Data

(60) Provisional application No. 63/476,326, filed on Dec. 20, 2022.

(51) Int. Cl.

| | |
|---|---|
| ***B65B 41/14*** | (2006.01) |
| ***B65B 55/20*** | (2006.01) |
| ***B65B 61/06*** | (2006.01) |

(52) U.S. Cl.

CPC ..... *B65B 55/20* (2013.01); *B65B 41/14* (2013.01); *B65B 61/06* (2013.01)

(58) Field of Classification Search

None

See application file for complete search history.

(56) References Cited

U.S. PATENT DOCUMENTS

| | | | | |
|---|---|---|---|---|
| 2009/0049798 | A1* | 2/2009 | Lorsch | B65B 55/20 53/403 |
| 2009/0308965 | A1* | 12/2009 | Piucci | B26D 7/0608 242/526 |
| 2012/0072016 | A1* | 3/2012 | Sperry | B31D 5/0073 221/199 |
| 2017/0166343 | A1 | 6/2017 | Murch et al. | |
| 2018/0127136 | A1* | 5/2018 | Hagestedt | B65B 61/12 |
| 2020/0207050 | A1* | 7/2020 | Hagestedt | B65D 75/367 |

* cited by examiner

*Primary Examiner* — Chinyere J Rushing-Tucker

(74) *Attorney, Agent, or Firm* — Fox Rothschild LLP

(57) ABSTRACT

Devices are provided for dispensing pillows for use in packaging arranged in web and having relative a relatively thick portion bordered by relatively thin portions that adjoins the individual pillows within the web. The systems can include a transfer unit having a pushing member. The pushing member is configured to engage the web of pillows as the pushing member moves so that the pushing member draws the web into the transfer unit, and moves the web through the transfer unit and toward an exit opening of the transfer unit. The devices further can include a separation unit having a cutting device, and a movable cover that at least partially encloses the cutting device to prevent unintentional contact with the cutting device.

50 Claims, 13 Drawing Sheets

SYSTEMS FOR DISPENSING PILLOWS FOR PRODUCT PACKAGING

CROSS-REFERENCE TO RELATED APPLICATIONS

The present application is a U.S. Non-Provisional which claims the benefit under 35 U.S.C. § 119(e) of U.S. Provisional application Ser. No. 63/476,326, filed Dec. 20, 2022, which is incorporated herein by reference in its entirety.

BACKGROUND

Inflated cushions, or air pillows, are a type of pillow widely used in product packaging. For example, air pillows often are used as protective packaging in a manner similar to, or in place of foam peanuts, crumpled paper, and similar products. As another example, air pillows may be used as protective packaging in place of molded or extruded packaging components. A typical type of air pillow is formed from films having two plies that are joined together by seals. The seals can be formed simultaneously with the inflation of the pillow, so as to capture air therein, or prior to inflation to define a film configuration having inflatable chambers. The inflatable chambers can be inflated with air or another gas and thereafter sealed to inhibit or prevent release of the air or gas.

The air pillows typically are formed as a web of adjoining air pillows, with each air pillow being joined to its adjacent pillows by the air pillow's webbing, i.e., the non-inflated portions of the air pillow that border the inflatable portion. One or more individual air pillows may be separated from the web and placed in a shipping container as the shipping container is loaded with the items to be protected by the air pillows. The air pillows may be separated from the webbing by cutting, tearing, or otherwise separating the webbing between adjacent air pillows, while leaving the inflated portion of the air pillow intact.

In some applications, the web may be dispensed directly from the equipment that produces the web. In other applications, the web may be transported to a storage bin for temporary storage, and may be dispensed from the storage bin as the air pillows are needed. Because the inflated air pillows can be punctured or otherwise damaged if improperly handled, transporting the web using automated equipment can present challenges. For example, the transporting equipment may damage the air pillows when the webbing becomes jammed. Also, when one or more of the pillows are fully or partially deflated due to a leak, a manufacturing defect, or other damage, the transporting equipment may not be able to move the web. Also, in applications where automated equipment is used to cut or otherwise separate the individual pillows from the web, it may be difficult to align the webbing with the cutting apparatus so that the cut is made in webbing, as opposed to the inflated pillow.

SUMMARY

In one aspect to the disclosed technology, a device is provided to for dispensing pillows for product packaging. Each of the cushioning pillows includes a first portion, and second portions each having a thickness less than a thickness of the first portion. The second portions of adjacent pillows adjoin each other to form a continuous web of the pillows. The web defines peaks coinciding with locations of maximum thickness of the first portions, and valleys located between the peaks.

The device includes a transfer unit having at least one pushing member. The pushing member is configured to engage the web of pillows so that the pushing member draws the web of pillows into the transfer unit, and moves the web of pillows through the transfer unit toward of an exit opening of the transfer unit, and the pushing member is angled away from a direction of rotation of the pushing members.

In another aspect to the disclosed technology, the pushing member includes a vane.

In another aspect to the disclosed technology, the device further includes a plurality of pushing members.

In another aspect to the disclosed technology, the transfer unit further includes a hub, the pushing member is mounted on the hub, and the pushing member extends in a direction substantially tangential to an outer surface of the hub.

In another aspect to the disclosed technology, the transfer unit further includes a guide configured to guide the web of pillows along a path.

In another aspect to the disclosed technology, a forward side of the pushing member is configured to contact and advance the pillows, the forward side of the pushing member is angled in relation to an adjacent portion of the guide by a first angle, a rearward side of the pushing member is angled in relation to the adjacent portion of the guide by a second angle supplemental to the first angle, and the first angle is less than the second angle.

In another aspect to the disclosed technology, the guide includes a curvilinear portion configured to guide the web of pillows along a curvilinear path, and a vertical portion adjoining the curvilinear portion and configured to guide the web of pillows to the exit opening.

In another aspect to the disclosed technology, the guide interferes with the pushing member as the pushing member moves past the guide.

In another aspect to the disclosed technology, the pushing member is configured to flex in response to the interference between the pushing member and guide.

In another aspect to the disclosed technology, the pushing member and the guide are configured so that the second portions of the pillows are entrained between a tip of the pushing member and the guide as the pushing member moves past the guide.

In another aspect to the disclosed technology, a spacing between tips of adjacent pushing members is about equal to a length of the pillows.

In another aspect to the disclosed technology, the guide is a second guide, the dispensing unit further includes a first guide, the first and second guides are configured to guide the web of pillows toward the pushing member, the first and second guides are spaced apart from each other by a spacing that ensures proper engagement of the web of pillows within the transfer unit, and the second guide is configured as a ramp that lifts the web of pillows as the second guide guides the web of pillows along the path.

In another aspect to the disclosed technology, the pushing member is configured to advance the web of pillows in a first direction, and the dispensing unit further includes an anti-reverse feature configured to inhibit movement of the web of pillows in a second direction opposite the first direction.

In another aspect to the disclosed technology, the anti-reverse feature includes a brush.

In another aspect to the disclosed technology, the dispensing unit further includes a wiper configured to contact the pillows and separate the pillows from the pushing member as the pushing member and the pillows rotate past the wiper.

In another aspect to the disclosed technology, the wiper includes a brush.

In another aspect to the disclosed technology, the device further includes a holding bin. The pushing member is configured to engage the web of pillows as the pushing member rotates so that the pushing member draws the web of pillows into the transfer unit from the holding bin.

In another aspect to the disclosed technology, the transfer unit is configured to be mounted on, and removed from the holding bin as a modular unit.

In another aspect to the disclosed technology, a device is provided to for dispensing pillows for product packaging. Each of the cushioning pillows includes a first portion, and second portions each having a thickness less than a thickness of the first portion. The second portions of adjacent pillows adjoin each other to form a continuous web of the pillows. The web defines peaks coinciding with locations of maximum thickness of the first portions, and valleys located between the peaks.

The device includes a separation unit configured to receive the web of packaging items. The separation unit includes an anvil, a cover mounted on the anvil and configured to move in relation to the anvil between a first position and second position of the cover, and a press movable between a first position and a second position of the press. The device also includes a cutting device mounted on the anvil and configured to sever the second portions of the pillows upon contact with the second portions. The cover at least partially encloses the cutting device when the cover is in the first position of the cover, the press is configured to move the cover from the first to the second position of the cover, and to push the webbing into the cutting device, when the press moves from the first to the second position of the press, and the press is configured to at least partially enclose the cutting device when the cover is in the second position of the cover.

In another aspect to the disclosed technology, a device is provided to for dispensing pillows for product packaging. Each of the cushioning pillows includes a first portion, and second portions each having a thickness less than a thickness of the first portion. The second portions of adjacent pillows adjoin each other to form a continuous web of the pillows. The web defines peaks coinciding with locations of maximum thickness of the first portions, and valleys located between the peaks.

The device includes a holding bin defining an internal volume configured to receive the web of pillows, a duct defining a channel configured to receive the web of pillows and guide the web of pillows to the internal volume of the holding bin in a first direction, and an air circulating device in fluid communication with the channel and configured to, during operation, direct air into the channel at a pressure and flow-rate sufficient to move the web of packaging items through the channel in the first direction. The device also includes an anti-reverse feature mounted within the channel and configured to inhibit movement of the web of pillows in a second direction opposite the first direction.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings, wherein like numerals denote like elements.

DETAILED DESCRIPTION

Figure 1:
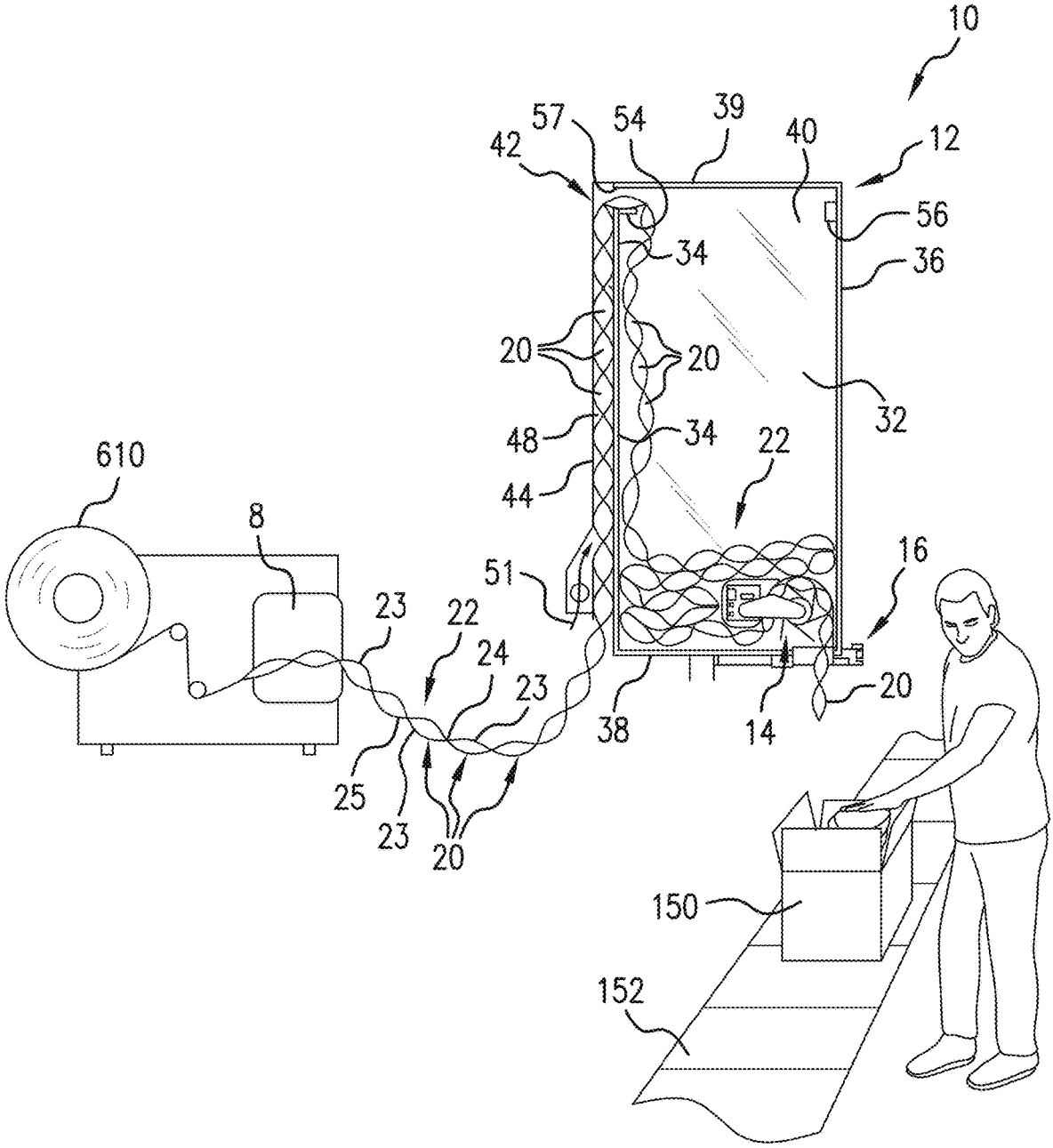
FIG. 1 is a side view of a system for dispensing air pillows, depicting a chain of the air pillows being fed to the system from an inflation and sealing machine, and depicting individual strings of the air pillows being packed in a container after being dispensed by the system, and with a sidewall of a holding bin of the system removed for clarity of illustration.

The following discussion omits or only briefly describes conventional features of the disclosed technology that are apparent to those skilled in the art. Reference to various embodiments does not limit the scope of the claims attached hereto. Additionally, any examples set forth in this specification are intended to be non-limiting and merely set forth some of the many possible embodiments for the appended claims. Further, particular features described herein can be used in combination with other described features in each of the various possible combinations and permutations. A person of ordinary skill in the art would know how to use the instant invention, in combination with routine experiments, to achieve other outcomes not specifically disclosed in the examples or the embodiments.

Unless otherwise specifically defined herein, all terms are to be given their broadest possible interpretation including meanings implied from the specification as well as meanings understood by those skilled in the art and/or as defined in dictionaries, treatises, etc. Unless defined otherwise, all technical and scientific terms used herein have the same meaning as commonly understood by one of ordinary skill in the art in the field of the disclosed technology. It must also be noted that, as used in the specification and the appended claims, the singular forms "a," "an" and "the" include plural referents unless otherwise specified, and that the terms "includes" and/or "including," when used in this specification, specify the presence of stated features, elements, and/or components, but do not preclude the presence or addition of one or more other features, steps, operations, elements, components, and/or groups thereof. Additionally, methods, equipment, and materials similar or equivalent to those described herein can also be used in the practice or testing of the disclosed technology.

Various examples of the disclosed technology are provided throughout this disclosure. The use of these examples is illustrative only, and in no way limits the scope and meaning of the invention or of any exemplified form. Likewise, the invention is not limited to any particular preferred embodiments described herein. Indeed, modifications and variations of the invention may be apparent to those skilled in the art upon reading this specification, and can be made without departing from its spirit and scope. The invention is therefore to be limited only by the terms of the claims, along with the full scope of equivalents to which the claims are entitled.

Certain relationships between features of the suppressor are described herein using the term "substantially" or "substantially equal." As used herein, the terms "substantially" and "substantially equal" indicate that the equal relationship is not a strict relationship and does not exclude functionally similar variations therefrom. Unless context or the description indicates otherwise, the use of the term "substantially" or "substantially equal" in connection with two or more described dimensions indicates that the equal relationship between the dimensions includes variations that, using mathematical and industrial principles accepted in the art (e.g., rounding, measurement or other systematic errors, manufacturing tolerances, etc.), would not vary the least significant digit of the dimensions. As used herein, the term "substantially parallel" indicates that the parallel relationship is not a strict relationship and does not exclude functionally similar variations therefrom. As used herein, the term "substantially orthogonal" indicates that the orthogonal relationship is not a strict relationship and does not exclude functionally similar variations therefrom.

Figure 2:
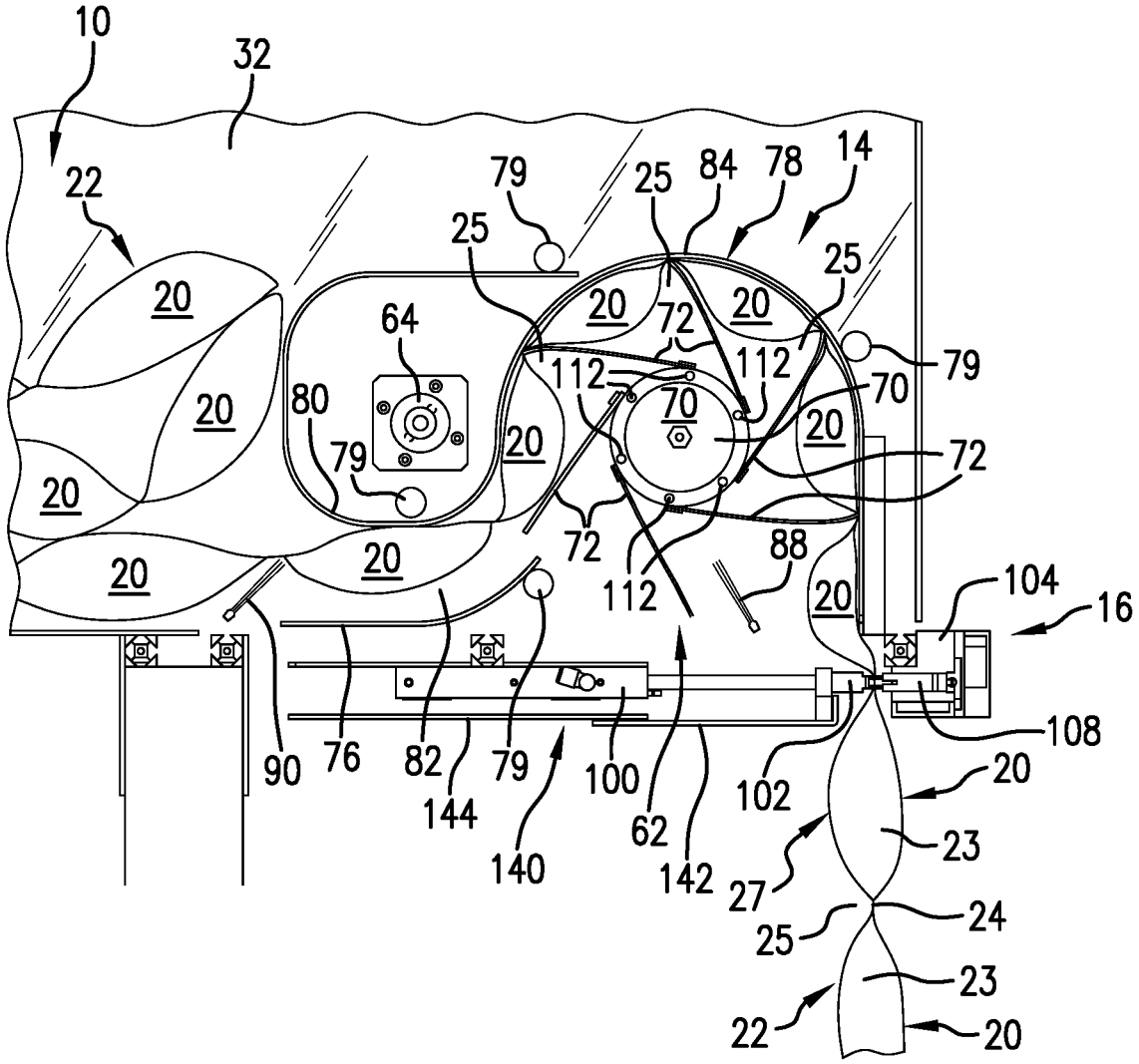
FIG. 2 is a magnified view of a portion of FIG. 1, depicting a dispensing unit of the system show in FIG. 1.
Figure 3:
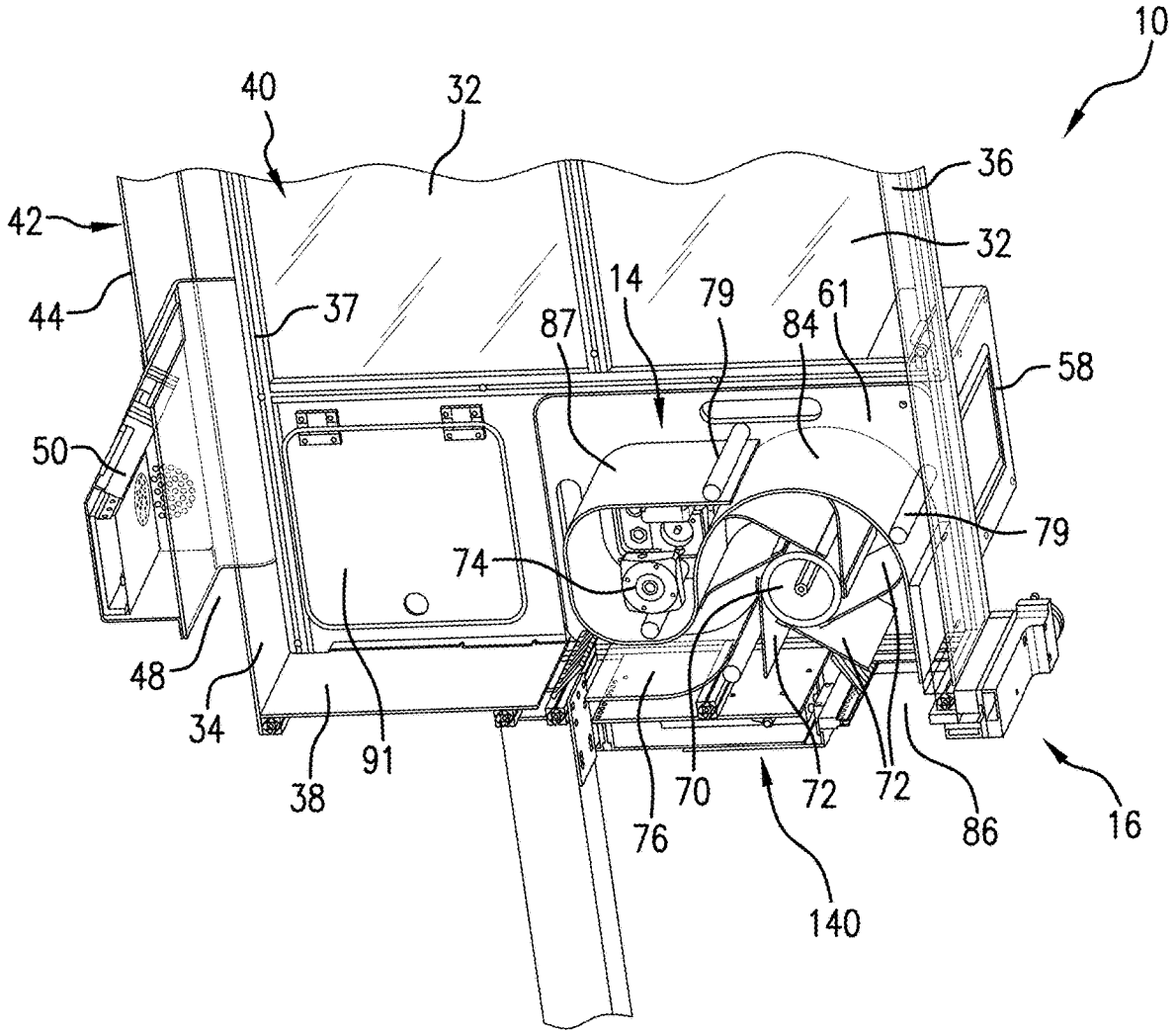
FIG. 3 is a top perspective view of the dispensing unit shown in FIG. 2.

A device 10 for dispensing pillows for product packaging, such as air pillows 20, is disclosed. Referring to FIGS. 1-3, the pillows 20 are provided to the device 10 as a continuous chain 22 of interconnected pillows 20. Each pillow 20 includes a relatively thick, or inflated portion 23, and relatively thin portions, or webbing 24 adjoining opposite sides of the inflated portion 23. The inflated portion 23 is filled with a fluid, such as air, and is sealed by its associated webbing 24 to prevent leakage of the fluid. The inflated portion 23 forms a relatively thick portion of the pillow 20, and the webbing 24 forms relatively thin portions of the pillow 20. The webbing 24 acts as a hinge that permits adjacent pillows 20 to rotate in relation to each other. The webbings 24 of adjacent pillows 20 adjoin each other, so that the air pillows 20 form the continuous chain 22. In certain applications, the webbing 24 can include perforations that facilitate separation of adjacent pillows 20 by tearing or other means. The relatively thick inflated portions 23 and the relatively thin webbing 24 define indentations or valleys 25 between the inflated portions 23 of adjacent pillows 20. The lengthwise mid-points of the inflated portions define peaks 27, or locations of maximum thickness, of the chain 22. (The "lengthwise" direction of the pillows 20, as used herein, coincides with the lengthwise direction of the chain 22, and with the direction in which the chain 22 and the pillows 20 are fed through the device 10.)

Each pillow 20 can have a lengthwise dimension of, for example, about four inches when deflated, and about three inches when inflated. Each pillow 20 can have a transverse dimension of, for example, about eight inches when deflated, and about seven inches when inflated. Each pillow 20 can have a maximum thickness of, for example, about 1 5/16 inches when inflated. The above dimensions for the pillow 20 are presented for illustrative purposes only. The device 10 can be configured for use with pillows 20 having dimensions, and dimension ratios, that are smaller, and larger than the above dimensions, The chain 22 of pillows 20 can be produced, for example, by a pillow inflation and sealing device 8 such as the inflation and sealing device as disclosed in U.S. Pat. No. 11,577,484, the contents of which are incorporated by reference herein in their entirety. FIG. 1 depicts the pillow inflation and sealing device 8 feeding the chain of air pillows 20 directly to the device 10. The pillow chain 22 can be produced by other types of devices and systems in the alternative.

Figure 17:
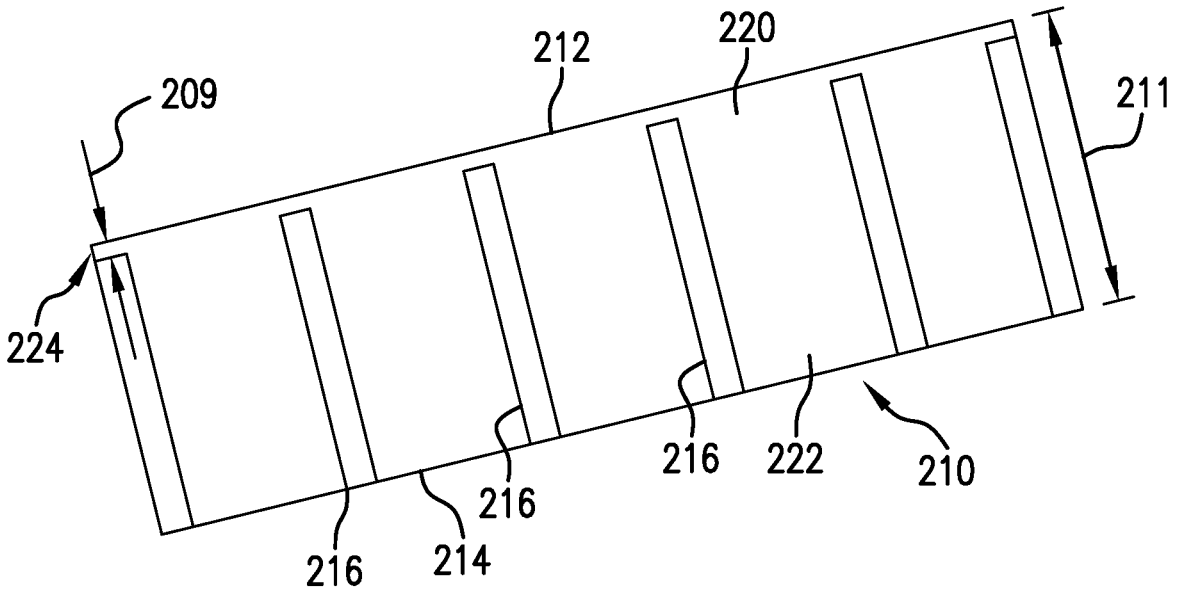
FIG. 17 is a top view of a web from which the chain of pillows depicted in FIGS. 1 and 2 can be formed.

FIG. 17 depicts a typical web 210 or strip of uninflated material to be inflated an sealed into the chain 22 of pillows 20. The web 210 may be made of a variety of different materials, including materials such as polyethylene resins such as LDPE, LLDPE, HDPE; metallocenes; EVAs; and blends thereof; and paper. The web 210 has a top edge 212 and bottom edge 214, both of which are closed. The web 210 includes generally transverse seals 216 The transverse seals 216 join a top sheet 220 of the web 210 to a bottom sheet 222 of the web 210 along the seals 216. The transverse seals 216 begin at the bottom edge 214 of the web 210 and extend to a distance 209 from the top edge 212. The web 210 has a width 211, which may be altered depending on the particular type of pillow to be manufactured. Specific details of the web 210 are presented for illustrative purposes only. The device10 can be used with pillows 20 formed from other types of webs.

In alternative embodiments, the chain 22 can be directed to a storage bin or other temporary storage means before being supplied to the device 10.

Alternative embodiments of the pillows 20 need not be inflated, and need not be formed from an inflatable material. For example, a web of non-inflatable pillows can be formed from one or more plies of paper or other material configured such that the paper defines an internal cavity within each pillow. Each internal cavity can be filled with padding or other material that provides a cushioning and/or a thermally-insulating effect. In this embodiment, the filled cavities form the relatively thick parts of the web, and the adjacent unfilled portions of the web that join the adjacent pillows form the thin portions of the web. In other alternative embodiments, the web can comprise consecutive envelopes of mailers. In some of these embodiments, the web can comprise consecutive loaded envelopes, with the loaded portions forming the relatively thick portions and the respective top and bottom seals of the envelopes forming relatively thin portions. In other alternative embodiments, the web can comprise sheets or pads having relatively thick or relatively thin portions such as foam pads, thermal insulating pads or cold chain material having compressed areas such as fold lines for forming the sheets or pads e.g. to line the interior of a box or other packaging container. The relatively thick portions and relatively thin portions of these alternative embodiments can function in a similar manner to the respective inflated portions 23 and webbings 24 of the chain 22.

As can be seen in FIG. 1, the device 10 includes a holding or accumulation bin 12, a dispensing or transfer unit 14, and a separating unit 16. The accumulation bin 12 receives the inflated pillows 20 from the inflating and sealing machine 8. The pillows 20, upon entering the device 10, are configured in the chain 22, with adjacent pillows 20 being interconnected by the webbing 24. The pillows 20 are fed into, and accumulate within the bin 12.

As shown in FIG. 1, the inflating and sealing device 8 is located upstream of the accumulation bin 12 relative to the direction of movement of the chain 22. The inflating and sealing device 8 can be positioned at a first height in relation to the accumulation bin 12 so that the chain 22 exits the inflating and sealing device 8 at a point lower than the bottom 38 of the accumulation bin 12. Positioning the inflating and sealing device 8 at the first height can allow for ease of access by an operator, such as to access the chain 22 or a pre-formed roll of chain material 610. This arrangement between the inflating and sealing device 8 and the accumulation bin 12 also creates sufficient space for the chain 22 to be fed into the accumulation bin 12 without tangling or interference. Additionally or alternatively, a conveyor 152 can be positioned below the accumulation bin 12, and in some embodiments below the transfer unit 14 at a second height relative to the accumulation bin 12 in order to facilitate transfer of the chain 22 from the accumulation bin 12 and into a packaging container 150.

The chain 22 is drawn into the transfer unit 14, which dispenses one or more pillows 20 in response to manual activation of the transfer unit 14 by the operator using a foot pedal (not shown) or other activation means, with the number of pillows 20 dispensed at one time being determined by how long the operator depresses the foot pedal. In addition, or alternatively, the transfer unit 14 can be configured to automatically dispense a predetermined number of pillows 20 at one time. For example, the transfer unit 14 can be configured to dispense a specific number of pillows 20 in response to an input from an external system such as an automated packaging machine with void-sensing capability, i.e., with the capability to sense and/or quantify the void or empty volume within a package that needs to be filled with the pillows 20.

Once the pillows 20 have been dispensed, the separating unit 16 separates or cuts the relatively short string of dispensed pillows 20 from the remainder of the chain 22.

Figure 4:
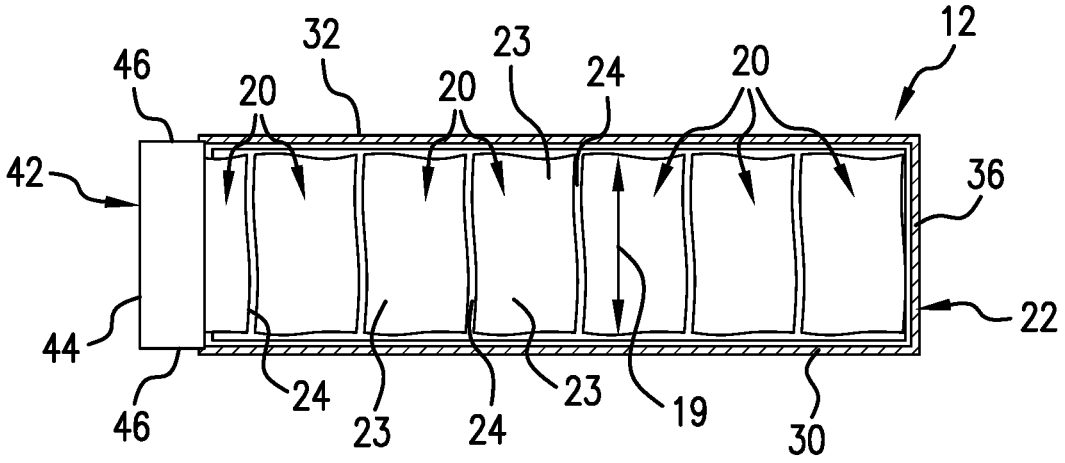
FIG. 4 is a top view of the holding bin of the system shown in FIG. 1, with a top of the holding bin removed for clarity of illustration.

Referring to FIGS. 1, 3, and 4, the accumulation bin 12 includes a first sidewall 30 and a second sidewall 32. The bin 12 also includes a forward wall 34 and a rearward wall 36 each connected to the first sidewall 30 and the second sidewall 32 by way of a frame 37 of the bin 12. As can be seen in FIG. 4, the first and second sidewalls 30, 32 have a substantially identical length. The forward and rearward walls 34, 36 likewise have a substantially identical length. The length of the forward and rearward walls 34, 36 is less than the length of the first and second sidewalls 30, 32, giving the bin 12 a generally rectangular configuration when viewed from above, i.e., from the perspective of FIG. 4.

The accumulation bin 12 further includes a bottom 38 and a top 39. The bottom 38 and the top 39 each are connected to the first and second sidewalls 30, 32, and to the forward and rearward walls 34, 36 by the frame 37. The first and second sidewalls 30, 32, the forward and rearward walls 34, 36, the bottom 38, and the top 39 define an interior volume 40 of the bin 12. The interior volume 40 receives the chain 22 of pillows 20. The first and second sidewalls 30, 32, the forward and rearward walls 34, 36, the bottom 38, and the top 39 can be formed from a clear or translucent material, so that the pillows 20 in the interior volume 40 are visible from outside the bin 12.

The first and second sidewalls 30, 32 are spaced apart by a distance about equal to the maximum width 19, or side to side dimension, of the pillows 20, as can be seen in FIG. 4. The chain 22 of pillows 20 is fed into the interior volume 40 in a direction generally parallel to the first and second sidewalls 30, 32, so that the respective sides, or outer edges of each pillow 20 assume a position directly adjacent the first or second sidewall 30, 32 as shown in FIG. 4. Because the first and second sidewalls 30, 32 are spaced by a distance about equal to the maximum width 19 of the pillows 20, the first and second sidewalls 30, 32 constrain the pillows 20 from lateral, or side to side movement, and from twisting about the lengthwise axis of the chain 22 as the chain 22 is drawn through the interior volume 40 of the bin 12.

Referring to FIGS. 1, 3, and 4, the device 10 also includes a three-sided duct 42 mounted on the exterior surface of the forward wall 34. The duct 42 includes a side panel 44, and two end panels 46 that adjoin opposite sides of the side panel 44, and extend perpendicularly to the side panel 44. The duct 42 and the underlying surface of the forward wall 34 define a vertically-extending channel 48, visible in FIGS. 1 and 3. A lower end of the channel 48 receives the chain 22 of pillows 20 from the inflation and sealing machine 8, as can be seen in FIG. 1. The duct 42 can be mounted separately from the accumulation bin 12 in alternative embodiments.

The device 10 further includes an air circulating device 50 in the form of a fan or blower mounted on the duct 42, proximate the lower end of the duct 42. The air circulating device 50 is depicted in FIG. 3. The air circulating device 50 is in fluid communication with the channel 48, and provides an upwardly-directed airflow within the channel 48. The upwardly-directed airflow entrains the pillows 20 within the channel 48, and causes the chain 22 to move upward within the channel 48. The airflow generated by the air circulating device 50 is denoted in FIG. 1 by the arrow 51.

The channel 48 can have a cross-sectional profile that substantially matches the height, i.e., thickness of the pillows 20, and the maximum width 19 of the pillows 20. Thus, the pillows 20 are constrained from turning or twisting while being transported upward through the channel 48.

Figure 5:
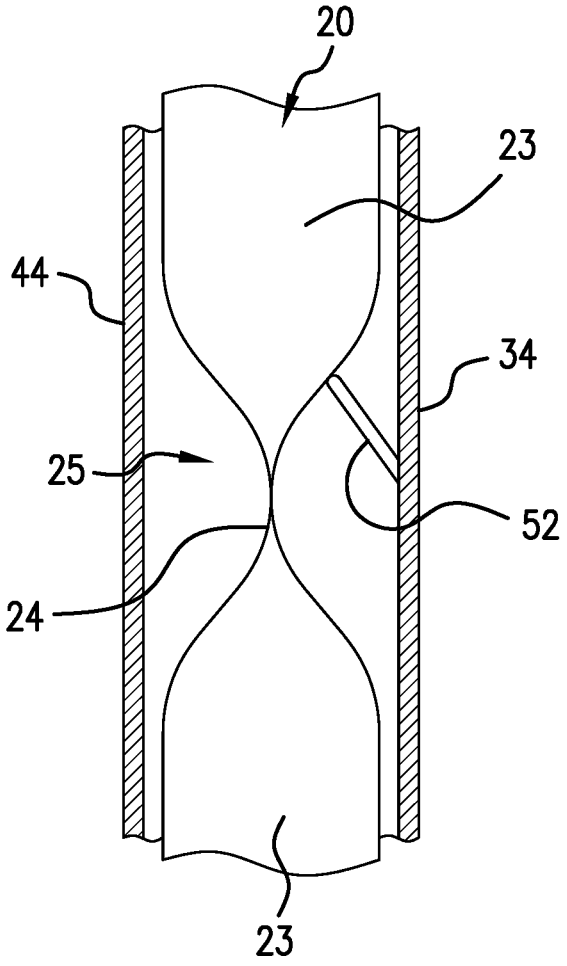
FIG. 5 is a magnified view of another portion of FIG. 1.

Referring to FIGS. 1 and 5, the duct 42 includes an anti-reverse feature that permits the chain 22 of pillows 20 to move upward within the channel 48, while preventing the pillow chain 22 from falling downward due to gravity (i.e., in a direction opposite the direction in which the chain 22 is fed to the accumulation bin 12) when the air circulating device 50 is deactivated. The anti-reverse feature can be, for example, an upwardly-angled plastic tab 52 having sufficient flexibility to permit the pillows 20 to pass over the tab 52 as the pillows 20 travel upward within the channel 48, while being sufficiently stiff to support the chain 22 of pillows 20 when the air circulating device 50 is not urging the chain 22 upward. In alternative embodiments, the anti-reverse feature can be a brush, a reed, or other type of device having the above-noted characteristics.

Referring to FIG. 1, the forward wall 34 of the accumulation bin 12 has a lip 54 formed on an upper end thereof. The forward wall 34 is shorter, i.e., has a smaller vertical dimension, than the first and second sidewalls 30, 32 of the bin 12. The lip 54, the first and second sidewalls 30, 32, and the top 39 define an opening 57 that adjoins the channel 48. The pillows 20 pass through the opening 57 and into the interior volume 40 of the bin 12 upon reaching the top of the channel 48.

The pillows 20 can fall downward, due to gravity, upon entering the interior volume. As noted above, the first and second sidewalls 30, 32 are spaced apart by a distance about equal to the maximum width 19 of the pillows 20, so that the first and second sidewalls 30, 32 constrain the pillows from twisting or otherwise rotating about the lengthwise axis of the chain 22 of pillows 20. Because each pillow 20 is connected to its adjacent pillows 20 by the webbing 24, the individual pillows 20 can rotate in relation to their adjacent pillows 20 about a transverse axis passing through their associated webbing 24. Thus, the chain 22 of pillows 20 can reverse direction as it settles within the accumulation bin 12. Typically, the chain 22 will fall randomly, and may form a series of repeating S-shapes as the pillows 20 fill in interior volume 40. The lateral, i.e., transverse, restraint exerted on the chain 22 by the first and second sidewalls 30, 32 of the bin 12 keeps the chain 22 from becoming twisted or tangled, or otherwise assuming a position or orientation that could prevent the chain 22 from being fed smoothly into the transfer unit 14.

The device 10 further includes a sensor 56 configured to sense the level of the pillows 20 within the accumulation bin 12. The sensor 56 is depicted in FIG. 1. The sensor 56 can be, for example, an optical sensor. Other types of sensors can be used in the alternative. The sensor 56 is communicatively coupled to a control unit 58 of the device 10. The control unit 58 is configured to activate the air circulating device 50 when the sensor 56 indicates that the level of the pillows 20 is below a predetermined threshold, e.g., below the line of sight of the sensor 56. The air circulating device 50, upon activation, feeds additional pillows 20 into the interior volume 40 of the bin 12 in the above-discussed manner. The control unit 58 will deactivate the air circulating device 50 upon receiving an indication from the sensor 56 that the level of the pillows 20 has reached the predetermined threshold.

Alternatively, or in addition, the device 10 can be configured with a provision that permits the operator to activate and deactivate the air circulating device 50, so that the operator can adjust the level of the pillows 20 within the bin 12 manually.

The transfer unit 14 is mounted on the accumulation bin 12, as can be seen in FIG. 1. The transfer unit 14 has a modular configuration that permits the transfer unit 14 to be installed in, and removed from the accumulation bin 12 as a single, self-contained cartridge or unit. Referring to FIGS. 1 and 3, the transfer unit 14 includes a first side panel (not shown); a second side panel 61; a rotating structure in the form of a paddlewheel 62; and a motor 64. The first side panel 60 and second side panel 61 are securely mounted on the frame 37 of the accumulation bin 12, proximate a lower end of bin 12, with the first side panel being located adjacent the first sidewall 30, and the second side panel 61 being located adjacent the second sidewall 32.

The control unit 58 is mounted on the outwardly-facing side of the second side panel 61, as can be seen in FIG. 3. The first side panel 60 and second side panel 61 are spaced apart by about the same distance as the first and second sidewalls 30, 32, i.e., the first side panel 60 and the second side panel 61 are spaced apart by a distance about equal to the maximum width 19 of the pillows 20.

The motor 64 is securely mounted on the inwardly-facing side of the second side panel 61, and is located within the interior volume 40 of the bin 12, as shown in FIG. 3. The paddlewheel 62 is mounted for rotation on a shaft (not shown). The shaft is securely mounted on the inwardly-facing side of the second side panel 61.

The motor 64 is a servo motor. Other types of motors, such as a stepper motor, can be used in alternative embodiments. The motor 64 drives the paddlewheel 62 in rotation, with torque being transferred from the motor 64 and to the paddlewheel 62 via a drive belt (not shown) or other suitable device.

Referring to FIGS. 2 and 3, the paddlewheel 62 includes a hub in the form of a drum 70. The paddlewheel 62 also includes six pushing members in the form of paddles or vanes 72 securely mounted on the drum 70. The drum 70 is mounted on its supporting shaft by way of bearings (not shown) that facilitate rotation of the drum 70 in relation to the shaft. The paddlewheel 62 is coupled to the drive belt by way of a pulley (not shown) securely mounted on an end of the drum 70. In alternative embodiments, the hub can be configured as an axle or other structure configured to support and carry the vanes 72, and the rotating structure can have a form other than the paddlewheel 62. In other alternative embodiments, vanes 72 can be connected directly to each other without a hub.

The vanes 72 are configured to move the chain 22 of pillows 20 by engaging the pillows 20 by way of the valleys 25 formed between the inflated portions 23 of adjacent pillows 20. More specifically, each vane 72 engages the webbing 24 between the pillows 20, and pushes against the inflated portion 23 of the pillow 20 adjacent the upstream side of the vane 72 as the paddlewheel 62 rotates.

Figure 18:
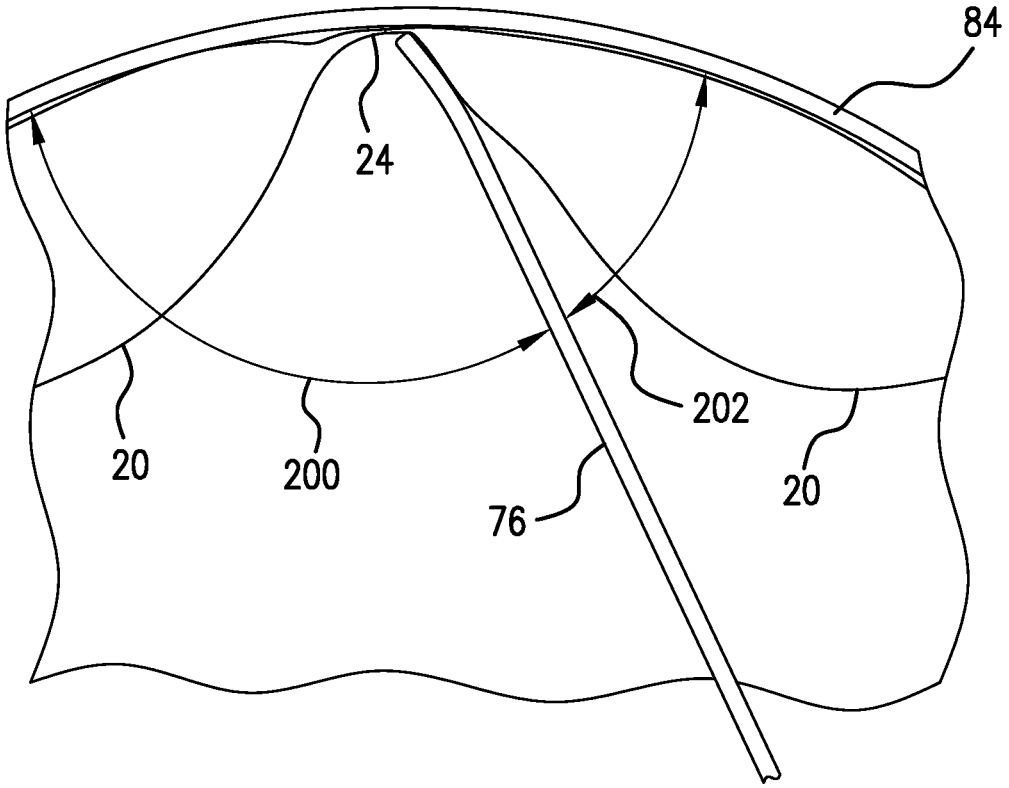
FIG. 18 is a magnified view of a portion of FIG. 2.

The vanes 72 are secured to the drum 70 so that each vane 72 extends tangentially from its point of attachment on the outer surface of the drum 70, as can be seen in FIG. 2. Thus, each vane 72 is offset by about 90 degrees from a direction normal to the location on the outer surface of the drum 70 at which the vane 72 is attached, causing the vanes 71 to be angled away from the direction of rotation of the paddlewheel 62. As can be seen in FIG. 18, the forward side of the each vane 72 is angled in relation to the second portion 84 of the second guide 78 by an angle 202, and the rearward side of the each vane 72 is angled in relation to the second portion 84 of the second guide 78 by a supplemental angle 200, with the angle 202 being less than the angle 200.

The vanes 72 can have orientations other than that shown in FIG. 2, in alternative embodiments. For example, the vanes 72 can extend in a direction normal to the adjacent surface of the drum 70 in alternative embodiments. In other alternative embodiments, the vanes 72 can extend at angles in between the respect angles associated with the normal and tangential directions to the adjacent surface of the drum 70.

The paddlewheel 62 is depicted with six of the vanes 72 for illustrative purposes only. The optimal number of vanes 72 can vary with factors such as the distance between adjacent webbings 24 within the chain 22 of pillows 20; and whether the vanes 72 are to engage every webbing 24 along the chain 22, or every second, third, or other multiple of the webbings 24. Thus, alternative embodiments can be configured with less, or more than six vanes 72.

In alternative embodiments, the pushing members can have a configuration other than the vanes 72. For example, the pushing members can be configured as rods, reeds, brushes, wires, or other structures capable of pushing the pillow chain 22 as discussed herein, without damaging the pillows 20 or the webbing 24.

Referring to FIGS. 2 and 3, the transfer unit 14 further includes a first guide 76, and a second guide 78. The first and second guides 76, 78 are secured to the first and second side panels 60, 61 by mounts 79 that extend between the first and second side panels 60, 61. The first and second guides 76, 78 guide the pillow chain 22 into, and around the paddlewheel 62, and out of the transfer unit 14. The first and second guides 76, 78 can be formed from a flexible plastic material. The first and second guides 76, 78 can be formed from other materials in alternative embodiments.

The first guide 76 is located proximate the bottom of the transfer unit 14, and is configured as a ramp that lifts the chain 22 of pillows 20 as the chain 22 approaches the paddlewheel 62, helping to ensure that the chain 22 is properly positioned to be engaged or entrained by the paddlewheel 62.

The second guide 78 has a first portion 80 that surrounds the motor 64 of the transfer unit 14, thereby preventing contact between the chain 22 and the motor 64. Also, the first portion 80 helps to guide the chain 22 of pillows 20 as the chain 22 approaches the paddlewheel 62. More specifically, the first portion 80 is spaced apart from the first guide 76, so that the first portion 80 and the first guide 76 define a pathway or channel 82 that constrains the pillows 20 from above and below, so that the chain 22 approaches the paddlewheel 62 in a manner that helps to ensure proper engagement between the chain 22 and the paddlewheel 62. The channel 82 is visible in FIG. 2.

The second guide 78 has a second portion 84 that adjoins the first portion 80. The second portion 84 extends over, and around the paddlewheel 62, and then downward, in a substantially vertical direction. The second portion 84 has a curvilinear section configured to urge the pillows 20 inwardly, toward the rotational centerline of the paddlewheel 62, thereby causing the pillows 20 to remain in contact with the rotating paddlewheel 62. The second portion 84 also includes a vertical section that guides the pillow chain 22 toward an exit opening 86 at the bottom of the transfer unit 14 after the chain 22 has been transported around the paddlewheel 62, as shown in FIGS. 2 and 3.

The length of each vane 72 is selected so that interference occurs between the vane 72 and the second portion 84 of the second guide 78 as the vane 72 rotates past the second portion 84, as can be seen in FIG. 2. The vanes 72 can be formed from a material, such as plastic, that permits the vanes 72 to flex in response to this interference, and that has sufficient softness to avoid damage to the webbing 24 as the outer end or tips of the vanes 72 contact the webbing 24 as the webbing 24 becomes entrained between the tips of the vanes 72 and the second portion 84 of the second guide 78.

As noted above, the pillow chain 22 is fed into the accumulation bin 12 via the channel 48, and accumulates in the accumulation bin 12 in a random or semi-random series of folds, with twisting or rotation of the chain 22 about its centerline being prevented by the constraint of the pillows 20 by the first and second sidewalls 30, 32. During startup of the device 10, the operator manually feeds the leading pillow 20 of the pillow chain 22 through the channel 82 defined within the transfer unit 14, and between the paddlewheel vanes 72 located directly downstream of the channel 82. Operator access to the pillow chain 22 and the paddlewheel 62 is provided by way of an access openings and access doors 91 incorporated into the first sidewall 30 and the second sidewall 32, as shown in FIG. 3 in relation to the second sidewall 32.

The random or semi-random series of folds can maintain the pillow chain 22 in a structured arrangement. For example, as shown in FIG. 1, a majority of the pillow chain 22 falls into the accumulator bin 12 in even layers of a length substantially equal to the distance between forward and rearward walls 34 and 36. Such a structured arrangement can prevent wrinkling, twisting, tying, knotting or entanglement of the pillow chain 22. In addition, the even layers ensure that the height of the pillow chain 22 increases at a relatively predictable rate and in a predictable manner facilitating with programming, e.g., for dispensing a predetermined number of pillows. The structured arrangement also reduces system downtime because the pillow inflation and sealing device 8 does not need to be shut off in order to untangle the pillow chain 22.

During the feeding and loading process, the operator can press a "load" button (not shown) or other input device communicatively coupled to the control unit 58. The load button generates an input that, when received by the control unit 58, causes the control unit 58 to activate the motor 64 in a manner that causes the motor 64 is slowly rotate the paddlewheel 62, so that at least the lead pillow 20 can be captured by the paddlewheel 62. The operator does not need to index the pillows 20 to the paddlewheel 62 during the feeding and loading process, because the paddlewheel 62, by virtue of the spacing between the vanes 72, establishes the sequencing naturally during the loading process, and maintains a one-to-one correspondence between the vanes 72 and the pillows 20 throughout the operation of the device 10.

As noted above, the device 10 can be activated by the operator by pressing a foot pedal or other input device; or upon receiving an external command requesting that a specific number of pillows 20 be dispensed. Upon activation, the device 10 sends an input to the motor 64 that causes the motor 64 to activate at its normal speed. The motor 64 rotates the paddlewheel 62 by way of the drive belt. The paddlewheel 62 rotates in a clockwise direction, from the perspective of FIGS. 1-3. The vane 72 located downstream, or behind, the lead pillow 20, pushes the inflated portion 23 of the lead pillow 20, causing the lead pillow 20 to rotate with the paddlewheel 62.

Also, the adjacent downstream vane 72 engages the webbing 24 immediately behind, or downstream, of the lead pillow 20. As noted above, the length of the vanes 72 and the spacing between the drum 70 and the second guide 78 are such that the vane 72 flexes as it drags the webbing 24 along the adjacent surface of the second guide 78. For example, the material, flexibility, length, or combinations thereof of the vanes 72 can result in the creation of a force, such as a frictional force, between the tips of the vanes 72 and the webbing 24 (which becomes trapped between the tips of the vanes 72 and the second guide 78), allowing the vanes 72 to drag the webbing 24 in the direction of rotation of the vanes 72. The positive contact between the vane 72 and the webbing 24, and the resulting drag on the webbing 24, further causes the pillow chain 22 to rotate with the paddlewheel 62. Also, the dragging of the webbing 24 by the vanes 72 helps the paddlewheel 62 to transport the chain 22 when one or more of the pillows 20 are fully or partially deflated, flat, or other otherwise defective such that the vanes 72 cannot push those particular pillows 20 by acting against the inflated portions 23 of the pillows 20. In the disclosed embodiment, it is believed that the noted dragging action of the vanes 72 and the ability of the paddlewheel 62 to accommodate five pillows 20 on a simultaneous basis makes it possible for the paddlewheel 62 to continue to transport the chain 22 when three or more consecutive pillows 20 are not properly inflated, e.g., when a pillow is punctured or is otherwise not fully inflated. (The force exerted by the vanes 72 on the properly-inflated pillows within the dispensing unit 14 also helps to advance the chain 22 when one or more pillows 20 are not properly inflated.)

Alternative embodiments of the transfer unit 14 can be configured to accommodate more, or less than five pillows 20 on a simultaneous basis. Also, the vanes 72 can be configured to have sufficient flexibility to allow the vanes 72 to pass over the pillows 20 within the transfer unit 14 without damaging the pillows 20 in the event the chain 22 of pillows 20 becomes jammed and cannot advance through the transfer unit 14. The optimal degree of flexibility for the vanes 72 is dependent upon the stiffness of the pillows 20, which can vary with factors such as the inflation pressure of the pillows 20, the material from which the pillows 20 are formed, etc.

The rotation of the pillow chain 22 with the rotating paddlewheel 62 eventually causes the next, or second pillow 20 in the chain 22 to come into contact with the paddlewheel 62 (if the second pillow 20 had not been brought into contact previously with the paddlewheel 62 during the loading process). In particular, the spacing between the vanes 72 is such that the next pillow 20 is drawn between the vane 72 located immediately behind the lead pillow 20, and the vane 72 located adjacent to, and downstream of that vane 72. Also, the two adjacent vanes 72, between which the second pillow 20 now is captured, contact the respective webbings 24 immediately upstream and downstream of the second pillow 20. The entrainment of subsequent pillows 20 in the chain 22 by the vanes 72 continues to occur in this manner as the paddlewheel 62 continues to rotate and draw additional pillows 20 from the accumulation bin 12, resulting in automatic indexing of the respective positions of the pillows 20 and the vanes 72, as can be seen in FIG. 2. In alternative embodiments, the number and spacing of the vanes 72 on the drum 70 can be varied so that two or more of the pillows 20 are captured in the space between adjacent vanes 72.

In the transfer unit 14, the spacing between the tips of the vanes 72 can be about equal to the length of the pillows 20. In alternative embodiments where two or more pillows 20 can be accommodated between adjacent vanes 72, the spacing between the vane tips can be about equal to the combined length of the pillows. The spacing between vane tips can be a function of the thickness of the pillows 20. For example, the maximum thickness of the pillows 20 can be about equal to 50% of the spacing between the vane tips. In other embodiments this percentage can range from about 10% to about 80%. The maximum thickness of the pillows 20 should be sufficiently large relative to the spacing between vane tips so that the vanes 72 flex when engaging with the pillows 20, but not so large that the pillows become lodged between adjacent vanes 72. The spacing between the vane tips can vary from these values in alternative embodiments.

The interaction between the individual vanes 72 and the chain 22 is dependent, in part, upon the physical characteristics of the chain 22. For example, relatively stiff or low-flexibility pillows 20, or relatively heavy pillows 20 may require that the flexibility of the vanes 72 be relatively low, to help ensure that the vanes 72 can exert suffice force on the pillows 20 to advance the chain 22, without the vanes 72 advancing or skipping over the pillows 20. Conversely, relatively flexible pillows 20 may require that the flexibility of the vanes 72 be relatively high, to help ensure that the vanes 72 can flex sufficiently to avoid puncturing or otherwise damaging the pillows 20.

Also, the relatively thick and flexible pillows 20 may necessitate higher flexibility in the vanes 72, and/or a higher angling of the vanes 72 in relation to the direction of rotation of the vanes 72, to help increase the contact area between the vanes 72 and the pillows 20 so that the force exerted on the pillows 20 by the vanes 72 is exerted a relatively large area on the pillows.

The paddlewheel 62 continues to draw or pull the accumulated chain 22 of pillows 20 from the internal volume 40 of the accumulation bin 12, with the first guide 76 and the first portion 80 of the second guide 78 guiding the chain 22 to the paddlewheel 62. The above-discussed restraint of the pillows 20 by the first and second sidewalls 30, 32 can help to ensure that the chain 22 does not become tangled, and is fed to the paddlewheel 62 in a jam-free manner.

Referring to FIG. 2, the pillows 20 are guided in a curvilinear path, and are maintained in contact with the paddlewheel 62 by the circular section of the second portion 84 of the guide 78. The chain 22 of pillows 20 eventually reaches the vertical section of the second portion 84, at which point the chain 22 travels downward. The chain 22 subsequently exits the transfer unit 14 by way of the exit opening 86. The control unit 58 deactivates the motor 64 when the operator releases the foot pedal, or when the predetermined number of pillows 20 have been dispensed from the dispending unit 14.

The device 10 further includes a wiper that helps to separate the pillows 20 from their adjacent vanes 72 in event the pillows 20 stick to the vanes 72 as a result of stiction or other factors. The wiper can be, for example, a brush 88, as shown in FIG. 2. The brush 88 is mounted on the first or second side panel 60, 61, adjacent the exit opening 86. The brush 88 extends upward, so that the upwardly-oriented bristles of the brush 88 contact each vane 72 as the vanes 72 rotate past the brush 88. The brush 88 is angled in the downstream direction, i.e., in the direction of movement of the chain 22. The brush 88, including the bristles thereof, is configured to have sufficient stiffness to impede movement of the pillow 20 along with its associated vane 72 in the event the pillow 20 fails to separate from the vane 72 as the vane 72 approaches the exit opening 86 and begins to rotate in the upstream direction, and away from the exit opening 86. The brush 88 has sufficient flexibility to avoid damaging the pillow 20. In alternative embodiments, the anti-stick device can be a tab, a reed, or other device having the above-noted characteristics.

The device 10 also includes another anti-reverse feature that prevents the pillow chain 22 from moving upstream (i.e., in a direction opposite the direction in which the chain 22 is fed through the transfer unit 14) and away the paddlewheel 62 after the motor 64 is deactivated and the paddlewheel 62 no longer is drawing the chain 22 of pillows 20 in the downstream direction. The anti-reverse feature can be, for example, a brush 90 that is mounted on the first side panel or the second side panel 61 immediately upstream of the first guide 76, and is angled upwardly and in the downstream direction. The brush 90 is depicted in FIG. 2. The brush 90, including its upwardly-oriented bristles, is configured to have sufficient flexibility to permit the pillows 20 to pass over the brush 90 as the pillows 20 travel downstream toward the paddlewheel 62, while being sufficiently stiff to prevent the chain 22 from moving in the upstream direction when the paddlewheel 62 is not rotating. In alternative embodiments, the anti-reverse feature can be a tab, a reed, or other device having the above-noted characteristics.

In alternative embodiments of the device 10, the transfer unit 14 can be configured to move the chain 22 linearly, or in an otherwise non-rotating manner. In such embodiments, the rotating structure of the transfer unit 14, e.g., the paddlewheel 62, and be replaced by structure that moves the chain 22 in a linear or otherwise non-rotational direction.

The separating unit 16 is located immediately downstream of the exit opening 86, and automatically separates the string of dispensed pillows 20 from the rest of the chain 22. Alternative embodiments of the device 10 can be configured without the separating unit 16.

In embodiments without a separating unit 16, the operator can manually tear the string of dispensed pillows 20 from the remainder of the chain 22. The webbing 24 of the chain 22 used in such embodiments can include perforations that permit the webbing 24 to be torn without deflating or otherwise damaging the adjacent inflated portions 23 of the pillows 20. Due to the reverse-angled orientation of the vanes 72 of the paddlewheel 26, the vane 72 that is contact with the particular webbing 24 that is to be torn is angled way from the direction in which the operator pulls the chain 22 to tear the webbing 24. Thus, the pulling force will drive the tip of that particular vane 72 further toward the underlying webbing 24 and the underlying surface of the second guide 78. The resulting friction between the vane 72, the webbing 24, and the second guide 78, in combination with the deactivated motor 64, result in a braking or ratcheting force that holds the paddlewheel 62 and the entrained webbing 24 in place as the webbing 24 is torn across its perforations, which in turn allows the operator to quickly and easily retrieve the string of dispensed pillows 20 in embodiments not equipped with the separating unit 16.

The separating unit 16 automatically separates the string of pillows 20 from the remainder of the chain 22 of pillows 20 after the string has been dispensed. The separating unit 16 is mounted directly below the transfer unit 14, as can be seen in FIGS. 2 and 3, so that the pillows 20 can pass through the separating unit 16 upon leaving the transfer unit 14 by way of the exit opening 86.

Referring to FIGS. 6-16, the separating unit 16 includes an actuator 100; and a press in the form of a pressure member or a pressure bar 102 connected to the actuator 100. The actuator 100 can be, for example, a pneumatic actuator. The actuator 100 is configured to move the pressure bar 102 linearly, between a first or retracted position shown in FIGS. 6 and 12, and a second or extended position shown in FIGS. 9 and 16.

The separating unit 16 also includes an anvil 104, and a protective element in the form of a guard or cover 108. The cover 108 is mounted on the anvil 104, and is configured to translate linearly in relation to the anvil 104 between a first, or safe position shown in FIGS. 6-8 and 12-15, and a second, or retracted position shown in FIGS. 9 and 16. The cover 108 is biased toward its safe position by a spring (not shown).

Figure 10:
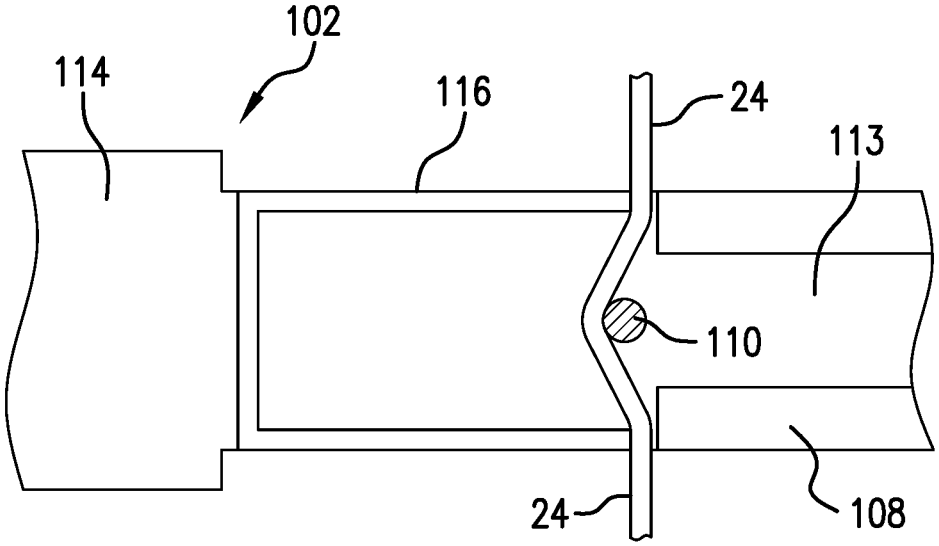
FIG. 10 is a magnified view of a portion of FIG. 9, further depicting a webbing of the chain of air pillows contacting a cutting wire of the separation device shown in FIGS. 6-9.
Figure 11:
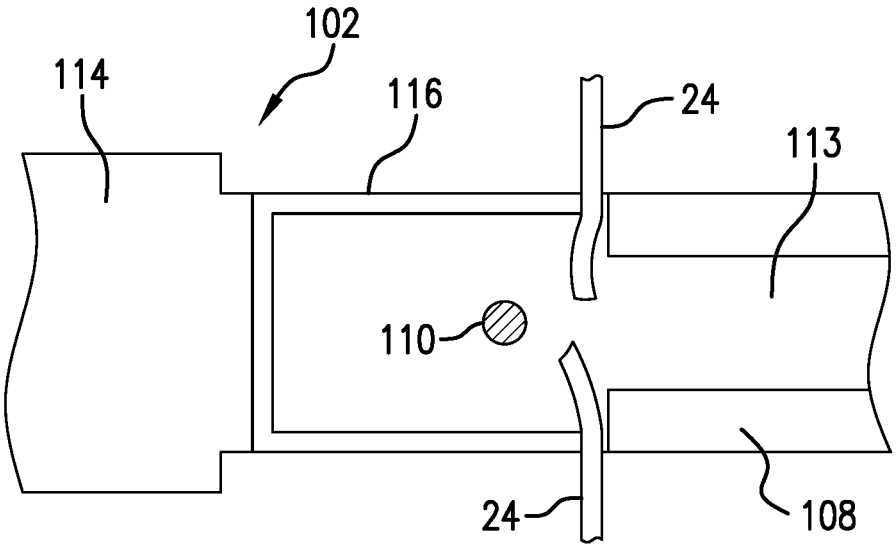
FIG. 11 is a magnified view of the area shown in FIG. 10, depicting the webbing after being severed by the cutting wire.

The separating unit 16 further includes a cutting device in the form of a hot wire or cutting wire 110, visible in FIGS. 10 and 11. The cutting wire 110 is mounted on the anvil 104. During operation, the cutting wire 110 generates heat that severs the webbings 24 of the pillow chain 22 when the webbings 24 are brought into contact with the cutting wire 110 as shown in FIG. 10. Other types of cutting devices, such as a flat film heater, can be used in lieu of the cutting wire 110 in alternative embodiments. In other alternative embodiments, the cutting device can be a sharp blade.

Figure 7:
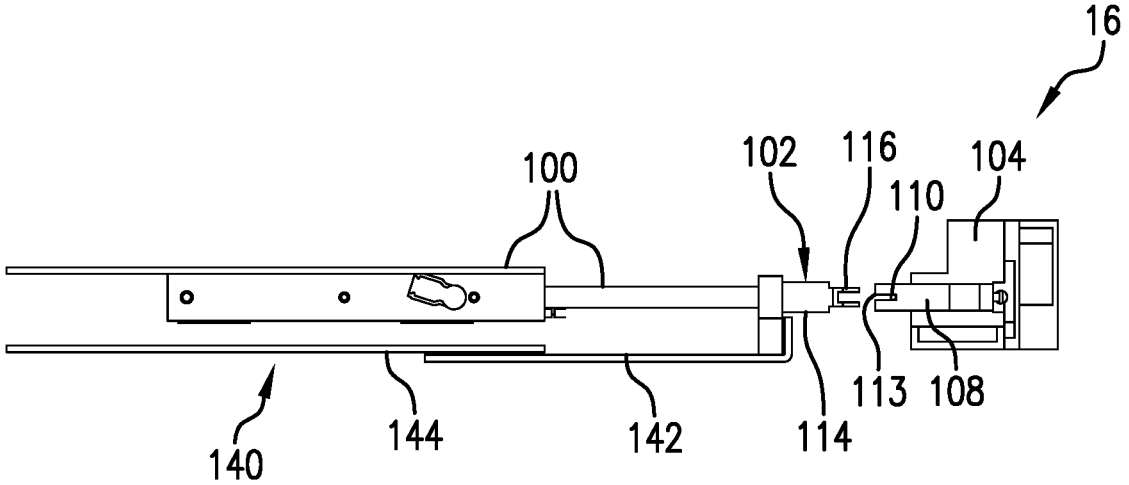
FIG. 7 is a side view of the severing device shown in FIG. 6, depicting the pressure bar moving from the retracted position and toward an extended position, and depicting the cover in the safe position.
Figure 8:
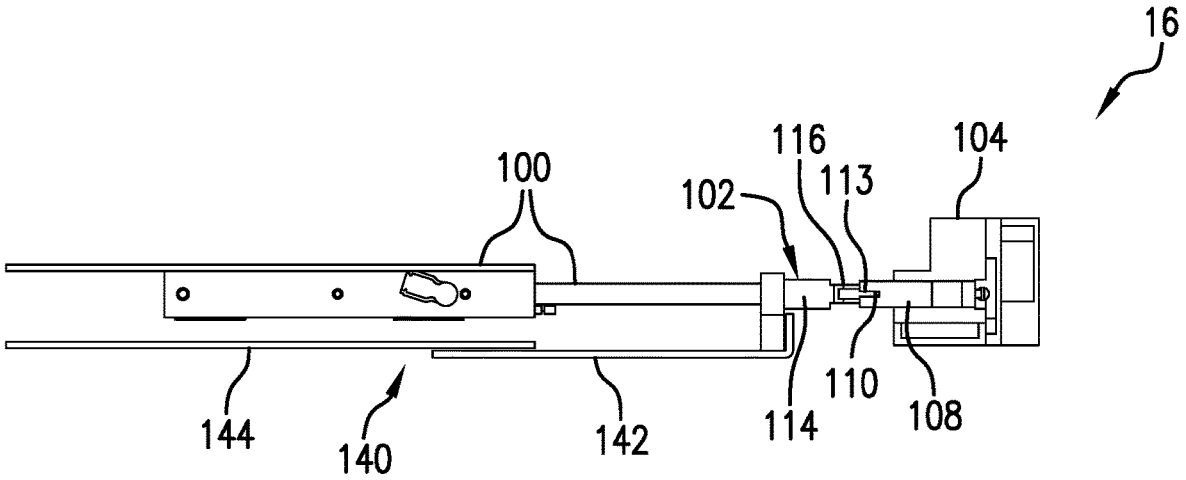
FIG. 8 is a side view of the severing device shown in FIGS. 6 and 7, depicting the pressure bar moving further from the retracted position and toward the extended position, and depicting the cover in the safe position as the pressure bar initially contacts the cover.
Figure 9:
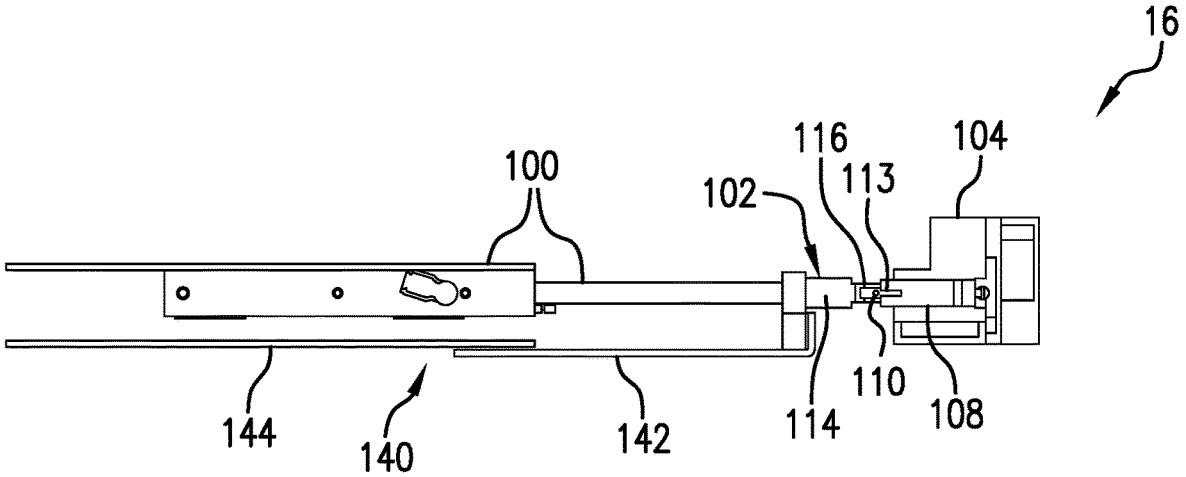
FIG. 9 is a side view of the severing device shown in FIGS. 6-8, depicting the pressure bar in the extended position, and depicting the cover in a retracted position of the cover.

The separating unit 16 also includes a bottom guard 140 comprising a movable portion 142 and a stationary portion 144, shown in FIGS. 3, 4, and 7-9. The movable portion 142 is connected to the actuator 100 so that the movable portion 142 translates linearly with the actuator 100 and the pressure bar 102. The stationary portion 144 is connected to the frame 37, so that the movable portion 142 can slide in relation to the stationary portion 144 as the movable portion 142 translates linearly, as can be seen in FIGS. 7-9.

Figure 6:
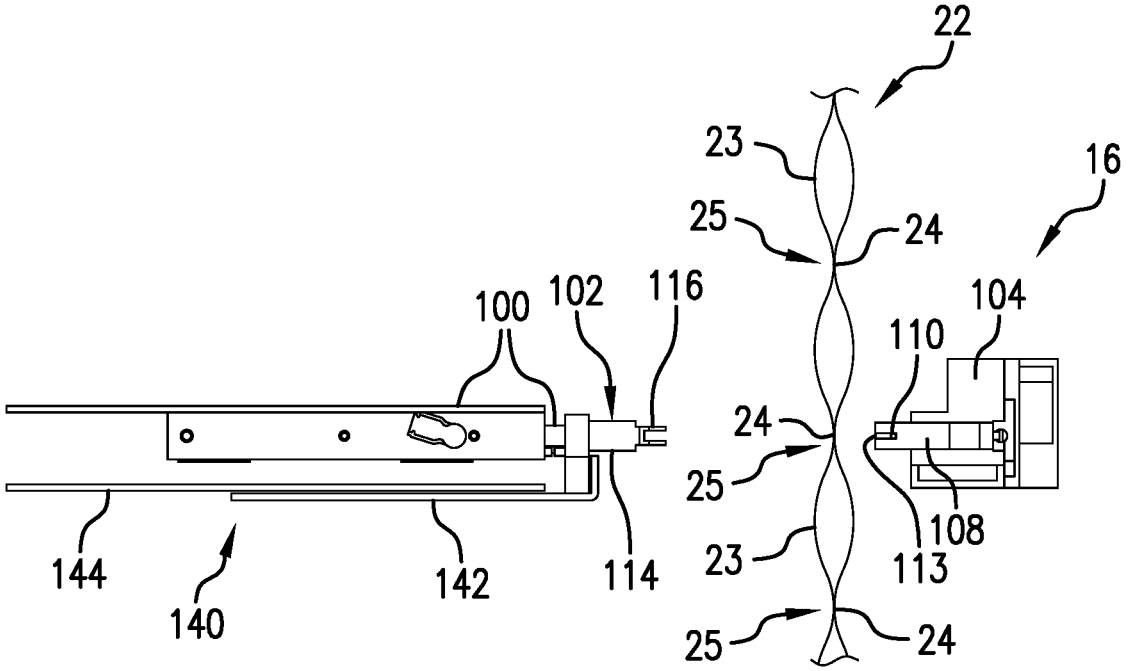
FIG. 6 is a side view of a severing device of the system shown in FIG. 1, depicting a pressure bar of the severing device in a retracted position, and depicting a cover of the severing device in a safe position.
Figure 12:
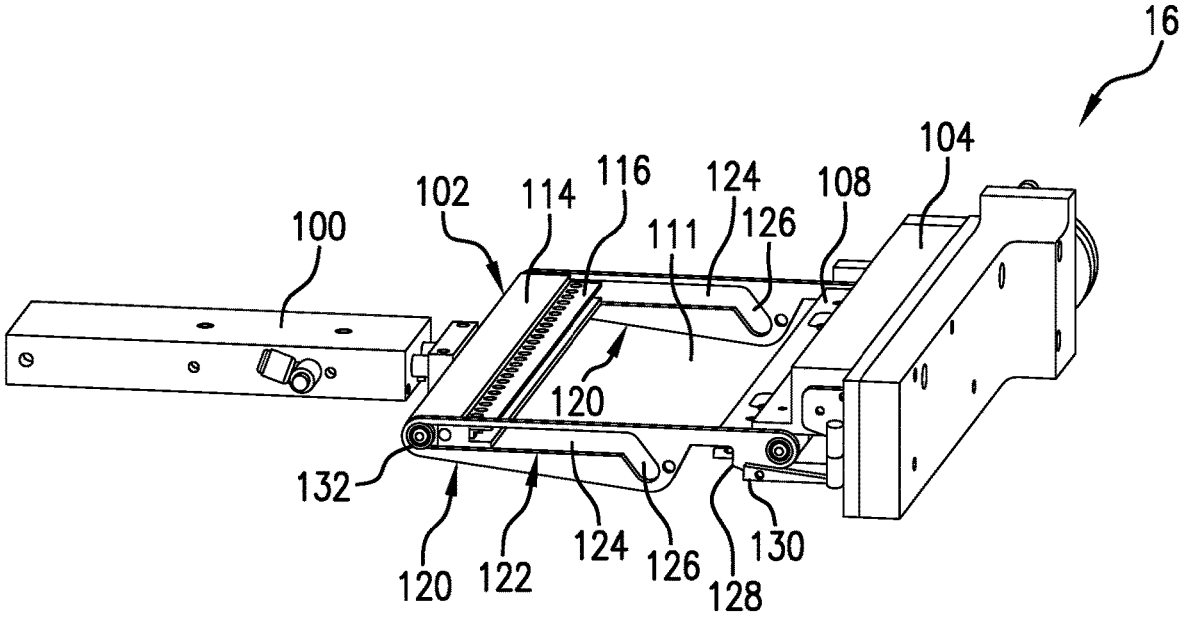
FIG. 12 is a top-rear perspective view of the severing device shown in FIGS. 6-11, depicting the pressure bar in the retracted position of the pressure bar, depicting the cover in the safe position, and depicting a locking arm of the severing device in a locking position.

The pressure bar 102 is spaced apart from the cover 108 when the pressure bar 102 and the cover 108 are in their respective retracted positions, so that the pressure bar 102 and the cover 108 define an opening 111, as depicted in FIG. 12. The opening 111 aligns with the exit opening 68 in the transfer unit 14, so that the string of pillows 20 dispensed by the transfer unit 14 passes through the opening 111 upon exiting the transfer unit 14. (The string of pillows 20 is shown in FIG. 6, and is not shown in FIGS. 7-10, for clarity of illustration.) The pressure bar 102, upon moving from the retracted position to the extended position, pushes the particular webbing 24 to be cut into the cutting wire 110 as shown in FIG. 10, causing the webbing 24 to be severed by the heated cutting wire 110 as shown in FIG. 11. As can be seen in FIG. 10, the restraint of the webbing 24 by a U-shaped member 116 of the pressure bar 102 and the cover 108 can result in some stretching of the webbing 24 before it is cut. The separating unit 16 can include a fan (not shown) or other provisions that help to ventilate fumes and odors that may be generated by the heating of the webbing 24.

The control unit 58 is configured to activate the motor 64 of the dispensing unit 14 so that the paddlewheel 62 will rotate in specific angular increments dependent upon, and corresponding to the number of pillows 20 to be dispensed. For example, the paddlewheel 62 is rotated by about 60 degrees when one pillow is to be dispensed, by about 120 degrees when two pillows are to be dispensed, by about 180 degrees when three pillows 20 are to be dispensed, etc.

The transfer unit 14 includes provisions that help to ensure that the particular webbing 24 to be cut aligns with the pressure bar 102 and the cutting wire 110. For example, the transfer unit 14 comprises six magnets 112 mounted on the side of the drum 70 of the paddlewheel 62, in equally-spaced angular increments. The magnets 112 are depicted in FIG. 2. The transfer unit 14 also includes a magnetic switch (not shown) that generates an output when the magnetic switch is aligned with one of the magnets 112. The magnets 112 and the magnetic sensor are positioned so that a webbing 24 of the pillow chain 22 will be aligned with the pressure bar 102 and the cutting wire 110, as depicted in FIGS. 2 and 10, when any of the magnets 112 are aligned with the magnetic switch. The magnets 112 and the magnetic switch thus act as a means for indexing the angular position of the paddlewheel 62 at the start of a dispense cycle with the positions of the pressure bar 102 and the cutting wire 110, so that the particular webbing 24 to be cut will align with the pressure bar 102 and the cutting wire 110 when the paddlewheel 62 has dispensed the desired number of pillows 20. The software in the control unit 58 also can facilitate adjustments in the targeting of the webbing 24 by permitting the operator to adjust a "Home Offset" parameter by way of a control interface with the control unit 58.

The control unit 58 incudes a "home" switch that, when pressed by the operator, causes the control unit 58 to activate the motor 64 of the transfer unit 14 to slowly rotate the paddlewheel 62 until one of the magnets 112 comes into alignment with the magnetic sensor. The control unit 58, the magnets 112, and the magnetic switch thereby act as a servo control system that allows the operator to "home" or "re-home" the paddlewheel 62. The homing or re-homing operation can be performed upon startup of the device 10, or whenever the angular position of the paddlewheel 62 at the start of a dispense cycle has drifted from its properly indexed position.

The cover 108 defines a narrow channel 113, as can be seen in FIGS. 10 and 11. As can be seen in FIGS. 6-8, the cutting wire 110 is positioned within the channel 113 when the cover 108 is in the safe position, so that the cutting wire 110 is enclosed on three sides by the cover 108. When the cover 108 is enclosed within the channel 113, the potential for the operator to come into contact with the cutting wire 110 is very low. The cover 108 thus acts as a safety device that minimizes the potential for the operator, or others, to come into contact accidentally with the heated cutting wire 110. When the cover 108 moves to the retracted position, as shown in FIGS. 9-11, the cover 108 no longer covers the cutting wire 110, and the cutting wire 110 can sever the webbing 24 when the webbing 24 is brought into contact with the cutting wire 110. FIGS. 10 and 11 respectively depict the webbing 24 immediately before, and after being cut or severed by the cutting wire 110.

The pressure bar 102 includes a body 114, and the U-shaped member 116. The U-shaped member is mounted on the body 114 so that the U-shaped member 116 faces the cutting wire 110 and the cover 108. As can be seen in FIG. 10, the U-shaped member 116 is configured to contact the forward, or exposed end of the cover 108 at locations above and below the channel 113, as the pressure bar 102 moves toward its extended position. Continued movement of the pressure bar 102 toward its extended position causes the U-shaped member 116 to urge the cover 108 toward its retracted position, against the spring bias of the cover 108. At the point when the pressure bar 102 reaches its extended position, shown in FIGS. 9, 10, and 15, the U-shaped member 116 has urged the cover 108 fully into retracted position, and the U-shaped member 116 is straddling the cutting wire 110. Thus, although the cover 108 has retracted away from the cutting wire 110, personnel remain protected from inadvertent contact with the cutting wire 110 because the cutting wire 110 at this point is covered by the U-shaped member 116.

Referring to FIGS. 12-16, the separating unit 16 also includes two control elements in the form of, for example, locking arms 120 mounted on opposite sides of the cover 108. A first end of each arm 120 is coupled to the cover 108 so that the arms 120 can rotate in relation to the cover 108 between a first or locking position shown in FIGS. 12 and 13, and a second or unlocked position shown in FIGS. 15 and 16.

Each arm 120 has a slot 122 formed therein. The slot 122 has an elongated first portion 124 that extends from a position proximate a second end of the arm 120, and a second portion 126 that adjoins the first portion 124. The second portion 126 is angled downwardly, and away from the first portion 124 by, for example, an included angle of about 127 degrees.

Figure 13:
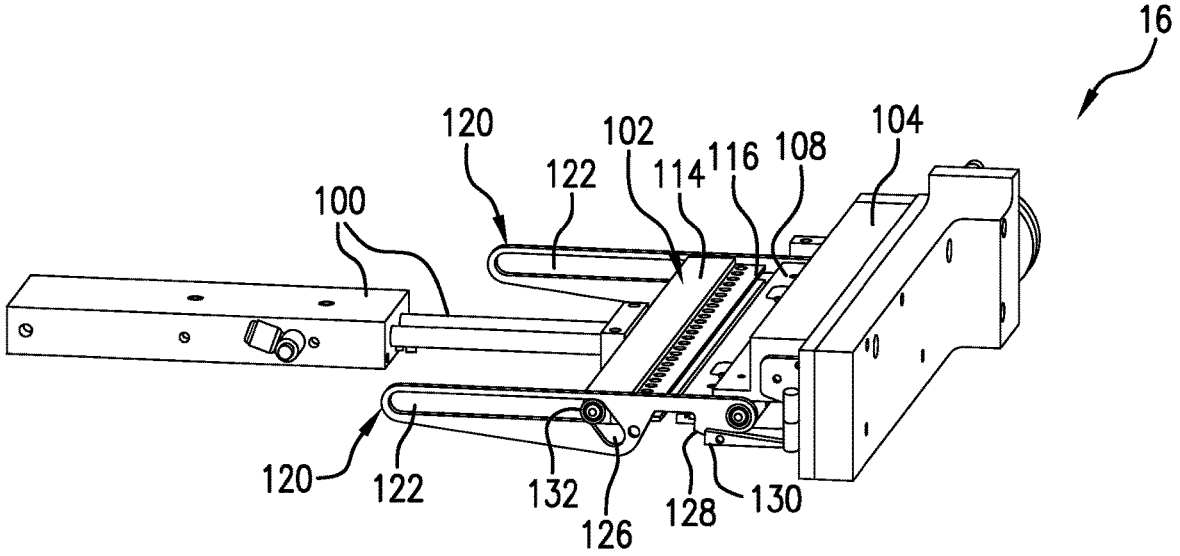
FIG. 13 is a top-rear perspective view of the severing device shown in FIGS. 6-12, depicting the pressure bar moving from the retracted position of the pressure bar and toward an extended position, depicting the cover in the safe position, and depicting the locking arm in the locking position.
Figure 14:
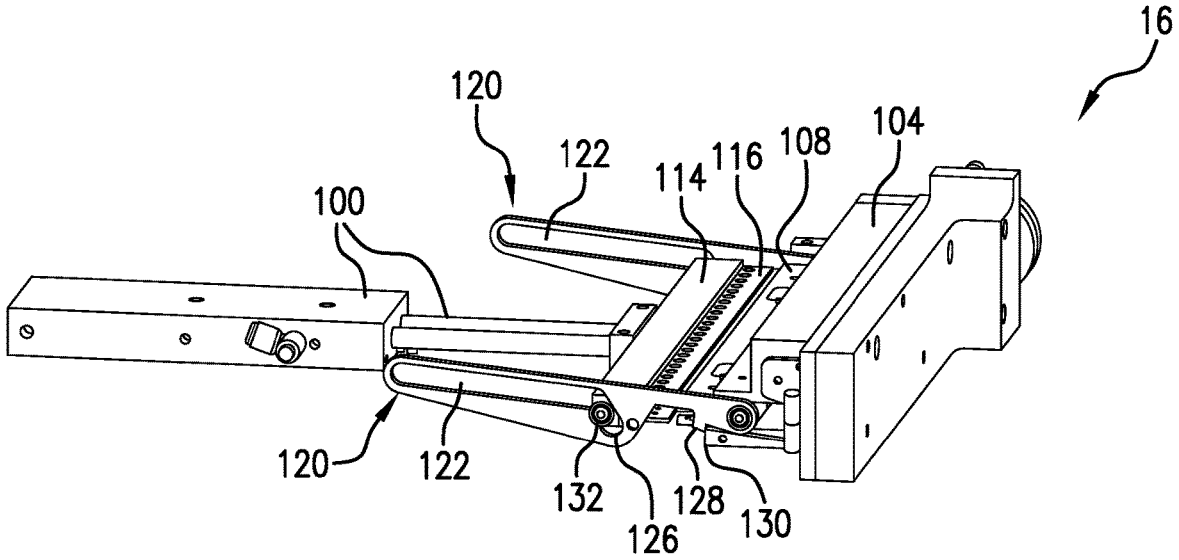
FIG. 14 is a top-rear perspective view of the severing device shown in FIGS. 6-13, depicting the pressure bar moving further from the retracted position of the pressure bar and toward the extended position, depicting the cover in the safe position, and depicting the locking arm moving from the locking position to an unlocked position.

Each arm 120 has a catch 128 formed thereon, proximate the first end of the arm 120. Each catch 128 is configured to engage a corresponding ledge or lip 130 located on the side of the anvil 104, when the arm 120 is in its first or locking position, as shown in FIGS. 12-14. The engagement of each catch 128 and its corresponding lip 130 prevents the cover 108 from moving from its safe position to its retracted position, helping to ensure that the cutting wire 110 remains at least partially covered, and not readily accessible by the operator or other personnel, at all times.

Figure 15:
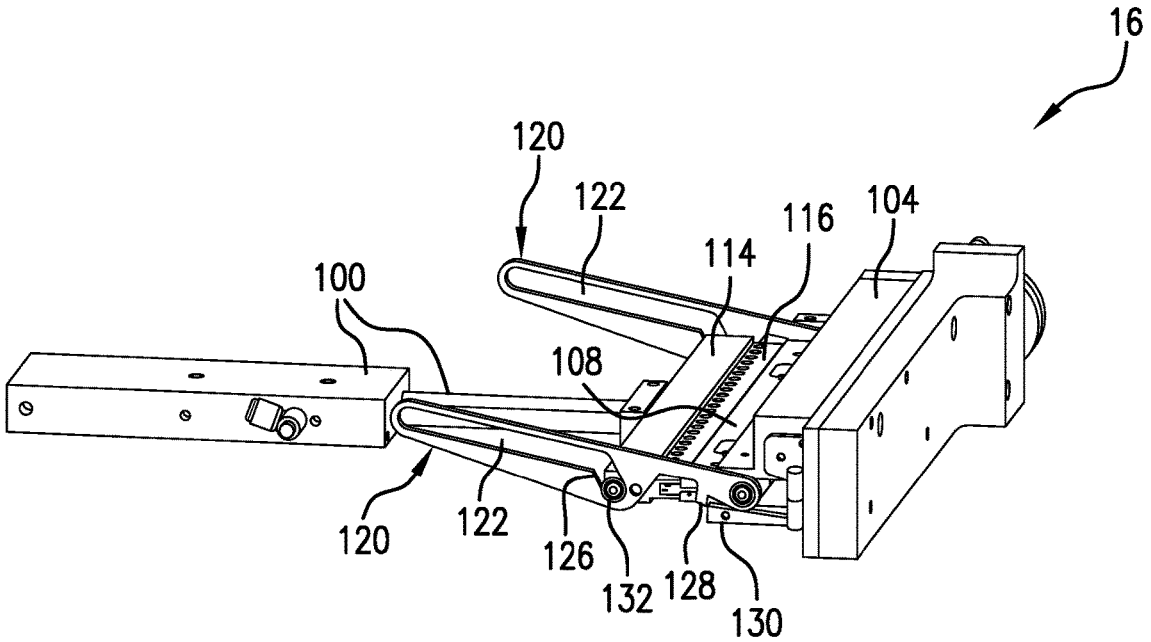
FIG. 15 is a top-rear perspective view of the severing device shown in FIGS. 6-14, depicting the pressure bar moving further from the retracted position of the pressure bar and toward the extended position, depicting the cover in the safe position as the pressure bar initially contacts the cover, and depicting the locking arm in the unlocked position.

The arms 120 are configured so that the catch 128 of each arm 120 disengages from its corresponding lip 130 as the pressure bar 102 moves from its retracted position and toward its extended position. In particular, the pressure bar 102 includes two rollers 132 located on opposite sides of the pressure bar 102. Each roller 132 is positioned within the slot 122 of a corresponding arm 120. The roller 132 is located in the first portion 124 of the slot 122 when the pressure bar 102 is in its retracted position, as shown in FIG. 12. Movement of the pressure bar 102 toward its extended position causes the attached roller 132 to translate in relation to the arm 120, within the first portion 124 of the slot 122. The continued movement of the pressure bar 102 toward its extended position eventually causes the roller 132 to reach the second portion 126 of the slot 122, as shown in FIG. 14. Once the roller 132 enters the second portion 126, further movement of the pressure bar 102, in combination with the downwardly-angled orientation of the second portion 126, produces a camming effect that causes the arm 120 to rotate in a clockwise direction, as can be seen in FIGS. 14 and 15. At the point where the U-shaped member 116 of the pressure bar 102 initially contacts the cover 108, as depicted in FIG. 15, the rotation of the arm 120 has lifted the catch 128 away from its corresponding lip 130, thereby unlocking the cover 108 and allowing the cover 108 move toward its retracted position in response to the continued movement of the pressure bar 102 toward is extended position. At this point, continued movement of the pressure bar 102 toward its extended position causes the attached arms 120 to move urge the cover 108 into its retracted position within the anvil 104, as shown in FIG. 16.

During operation, the transfer unit 14, through rotation of the paddlewheel 62, dispenses a string of pillows 20 through the exit opening 86. The length of the string is determined automatically by the control unit 58, or by the amount of time the operator has depressed the foot pedal or other actuating means of the device 10. The pillows 20, upon exiting the transfer unit 14, travel downward into the opening 111 defined by the pressure bar 102 and the cover 108 while in their respective retracted positions as depicted in FIGS. 6 and 12. The angular position of the paddlewheel 62 is indexed to the locations of the pressure bar 102 and the cutting wire 110, so that the specific webbing 24 to be cut aligns with, and is positioned between, the pressure bar 102 and the cutting wire 110.

The control unit 58 at this point activates the actuator 100 of the separating unit 16. The actuator 100 drives the pressure bar 102 toward the webbing 24, as shown in FIGS. 7, 13, and 14. The U-shaped member 116 of the pressure bar 102 subsequently contacts the webbing 24, with the webbing 24 becoming sandwiched between the U-shaped member 116 and the cover 108, as can be seen in FIG. 10. As the U-shaped member 116 is about to urge the webbing 24 into the cover 108, the arms 120 have been rotated to their unlocked position by interaction with the rollers 132, as shown in FIG. 15.

Figure 16:
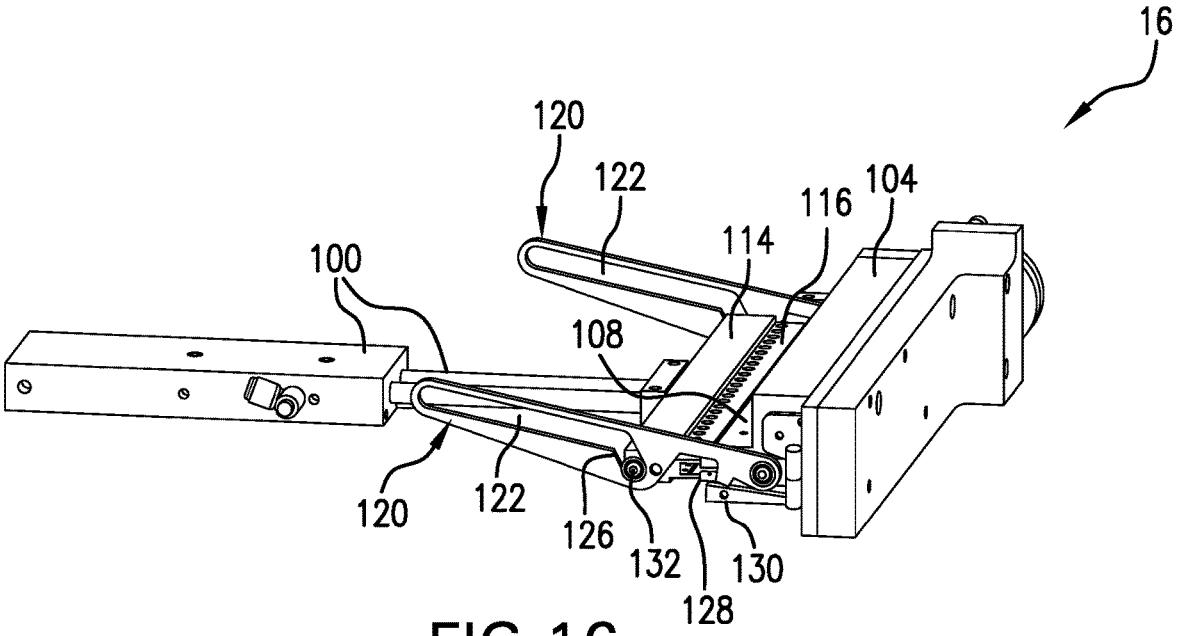
FIG. 16 is a top-rear perspective view of the severing device shown in FIGS. 6-15, depicting the pressure bar in the extended position, depicting the cover in a retracted position of the cover, and depicting the locking arm in the unlocked position.

Further movement of the pressure bar 102 toward the cover 108 causes the cover 108 to retract into the anvil 104, as depicted in FIGS. 9 and 16. Once the cover 108 has retracted, the cutting wire 110 no longer is disposed within the channel 113 in the cover 108, and the webbing 24 can come into contact with the cutting wire 110 as the webbing 24 is urged toward the cutting wire by the U-shaped member 116 of the pressure bar 102. In addition, as the pressure bar 102 contacts the cover 108, the webbing 24 can be pulled and stretched between the prongs of U-shaped member 116, towards the cutting wire 110 as shown in FIG. 10.

Contact between the webbing 24 and the cutting wire 110 cuts, or severs the webbing 24, separating the string of dispensed pillows 20 from the rest of the chain 22, as shown in FIG. 11. At this point, the pressure bar 102 is in its extended position and the cover.

Also, when the cutting or severing action takes place to separate the string of pillows 20 from the rest of the chain 22, the control unit 58 generates an output that causes the paddlewheel 62 to rotate slightly in a direction opposite the dispending direction, i.e., opposite the direction in which the paddlewheel 62 rotated to dispense the string. The reverse rotation of the paddlewheel 62 provides mechanical assistance in the separation of the string of pillows 20 from the rest of the chain 22. The reverse rotation also minimizes contact between the pillows 20 and the hot cutting wire 110 by retracting the newly-formed leading edge of the pillow chain 22 from the contact zone of the cutting wire 110, thereby preventing the leading edge from sticking to the cutting wire 110 and causing fouled operation of the device 10.

The string of pillows 20, after being separated from remainder of the chain 22, is held in place by the U-shaped member 116 of the pressure bar 102 acting against the cover 108, so that the string remains suspended from the separating unit 16, as shown in FIG. 11. The operator, or a separate automated device can remove the string of dispensed pillows 20 from the separating unit 16 easily, by pulling the string. The control unit 58 can command the actuator 100 to move the pressure bar 102 to its retracted position at the start of the next dispensing cycle, so that the separating unit 16 is ready to receive the next string of pillows 20 to be dispensed from the transfer unit 14. More specifically, in this mode of operation, the start of the next, or subsequent cycle to dispense a string of pillows 20 to the operator, or to another automated device, will cause the actuator 100 to retract prior to the start of the dispensing process. As noted above, the next cycle can be initiated by an input to the control unit 58 from the operator by way of an input device such as a foot pedal, a pushbutton, etc. The next cycle also can be initiated by way of a signal sent to the device 10 from another automated device; or by way of another form of input to the device 10.

Alternatively, the operator can select a mode of operation in which the control unit 58 causes the actuator 100 to retract the pressure bar 102 immediately after the webbing 24 has been severed, so that the string of pillows 20 drops freely from the separating unit 16.

What is claimed is:

1. A device for dispensing pillows for product packaging, each of the cushioning pillows comprising a first portion, and second portions each having a thickness less than a thickness of the first portion, the second portions of adjacent pillows adjoining each other to form a continuous web of the pillows, the web defining peaks coinciding with locations of maximum thickness of the first portions, and valleys located between the peaks, the device comprising:

a transfer unit including:

a rotatable hub, and a pushing member connected to the hub; wherein:

the pushing member is configured to engage the web of pillows so that the pushing member draws the web of pillows into the transfer unit, and moves the web of pillows through the transfer unit toward of an exit opening of the transfer unit; and the pushing member is angled away from a direction of rotation of the pushing member and extends from the hub in a direction away from the direction of rotation of the pushing member.

2. The device of claim 1, wherein the pushing member includes a vane.

3. The device of claim 1, wherein the transfer unit further includes a plurality of pushing members.

4. The device of claim 3, wherein a spacing between tips of adjacent pushing members is about equal to a length of the pillows.

5. The device of claim 1, wherein the pushing member extends in a direction tangential to an outer surface of the hub.

6. The device of claim 1, wherein the transfer unit further comprises a guide configured to guide the web of pillows along a path.

7. The device of claim 6, wherein:

a forward side of the pushing member is configured to contact and advance the pillows;

the forward side of the pushing member is angled in relation to an adjacent portion of the guide by a first angle;

a rearward side of the pushing member is angled in relation to the adjacent portion of the guide by a second angle supplemental to the first angle; and the first angle is less than the second angle.

8. The device of claim 6, wherein the guide comprises:

a curvilinear portion configured to guide the web of pillows along a curvilinear path; and a vertical portion adjoining the curvilinear portion and configured to guide the web of pillows to the exit opening.

9. The device of claim 6, wherein the guide interferes with the pushing member as the pushing member moves past the guide.

10. The device of claim 9, wherein the pushing member is configured to flex in response to the interference between the pushing member and guide.

11. The device of claim 10, wherein the pushing member and the guide are configured so that the second portions of the pillows are entrained between a tip of the pushing member and the guide as the pushing member moves past the guide.

12. The device of claim 6, wherein:

the guide is a second guide;

the dispensing unit further comprises a first guide;

the first and second guides are configured to guide the web of pillows toward the pushing member;

the first and second guides are spaced apart from each other by a spacing that ensures proper engagement of the web of pillows within the transfer unit; and the second guide is configured as a ramp that lifts the web of pillows as the second guide guides the web of pillows along the path.

13. The device of claim 1, wherein:

the pushing member is configured to advance the web of pillows in a first direction; and the dispensing unit further comprises an anti-reverse feature configured to inhibit movement of the web of pillows in a second direction opposite the first direction.

14. The device of claim 13, wherein the anti-reverse feature comprises a brush.

15. The device of claim 1, wherein the dispensing unit further comprises a wiper configured to contact the pillows and separate the pillows from the pushing member as the pushing member and the pillows rotate past the wiper.

16. The device of claim 15, wherein the wiper comprises a brush.

17. The device of claim 1, further comprising a holding bin, wherein the pushing member is configured to engage the web of pillows as the pushing member rotates so that the pushing member draws the web of pillows into the transfer unit from the holding bin.

18. The device of claim 17, wherein the transfer unit is configured to be mounted on, and removed from the holding bin as a modular unit.

19. A device for dispensing pillows for product packaging, each of the cushioning pillows comprising a first portion, and second portions each having a thickness less than a thickness of the first portion, the second portions of adjacent pillows adjoining each other to form a continuous web of the pillows, the web defining peaks coinciding with locations of maximum thickness of the first portions, and valleys located between the peaks, the device comprising:

a separation unit configured to receive the web of packaging items, the separation unit comprising:

an anvil configured to support a cover and a cutting device of the separation unit, the cover, the cover mounted on the anvil and configured to move in relation to the anvil between a first position and second position of the cover, a press movable between a first position and a second position of the press, the press configured to move the cover from the first to the second position of the cover, and to push the webbing into the cutting device, when the press moves from the first to the second position of the press, the press also configured to at least partially enclose the cutting device when the cover is in the second position of the cover; and the cutting device, the cutting device mounted on the anvil and configured to sever the second portions of the pillows upon contact with the second portions, wherein:

the cover at least partially encloses the cutting device when the cover is in the first position of the cover.

20. The device of claim 19, wherein the cutting device includes a cutting wire.

21. The device of claim 19, further comprising a control element connected to the cover and configured to rotate in relation to the cover between a first and second position of the control element; wherein:

the control element is configured to engage the anvil when the control element is in the first position of the control element; and the engagement of the control element and the anvil prevents the cover from moving from the first to the second position of the cover.

22. The device of claim 21, wherein the control element includes a locking arm comprising a latch configured to engage the anvil when the control element is in the first position of the control element.

23. The device of claim 22, wherein:

the press comprises a roller;

the locking arm has a slot formed therein and configured to receive the roller;

the roller translates within the slot as the press moves from the first to the second position of the press; and the slot is configured so that the translation of roller within the slot causes the control element to rotate in relation between the first and second positions of the control element.

24. The device of claim 23, wherein:

the slot includes a first portion that extends in a first direction, and a second portion that extends in a second direction different than the first direction; and the slot is further configured so that translation of the roller within the second portion of the slot urges the control element from the first to the second position of the control element.

25. The device of claim 24, wherein the cover does not enclose the cutting device when the cover is in the second position of the cover.

26. The device of claim 25, wherein the cover defines a channel configured to receive the cutting device when the cover is in the first position of the cover.

27. The device of claim 26, wherein:

the press includes a body, and a U-shaped member mounted on the body and facing the cutting device and the cover; and the U-shaped member is configured to contact an end of the cover at locations above and below the channel as the press moves from the first to the second position of the press.

28. The device of claim 27, wherein the U-shaped member is configured to pull and stretch the second portions of the pillows between prongs of the U-shaped member as the press moves from the first position to the second position of the press.

29. The device of claim 28, wherein the U-shaped member is further configured to at least partially enclose the cutting device when the cover is in the second position of the cover.

30. The device of claim 28, wherein the U-shaped member and the cover are further configured to contact and pinch the second portions of the pillows at locations above and below the channel.

31. The device of claim 19, wherein the separation unit further includes an actuator configured to move the press between the first and second positions of the press.

32. The device of claim 31, further comprising a transfer unit including a pushing member, and a motor configured to, during operation, move the pushing member, wherein:

the pushing member is configured to engage the web of pillows so that the pushing member draws the web of pillows into the transfer unit and moves the web of pillows along a path within the transfer unit and out of an exit opening of the transfer unit;

the press and the cover define an opening configured to receive the web of pillows when the press is in the first position of the press; and the opening defined by the press and the cover is located directly below the exit opening of the transfer unit.

33. The device of claim 32, wherein:

the device further includes a control unit communicatively coupled to the motor; and the control unit and the motor are configured to position the pushing member in a plurality of predetermined angular positions at which one of the second portions of the pillows aligns with the press and the cutting device.

34. The device of claim 33, wherein:

the transfer unit further includes a hub, a plurality of the pushing members mounted on the hub, a plurality of magnets mounted on the hub, and a sensor;

the sensor and the magnets are configured so that the sensor aligns with respective ones of the magnets when the pushing members are positioned in the predetermined angular positions;

the sensor is configured to generate an output indicating when the sensor is aligned with any of the magnets; and the control unit and the motor are further configured to position the pushing members so that one of the magnets aligns with the sensor.

35. The device of claim 34, wherein the control unit and the motor are configured to reverse a direction of rotation of the hub upon, or after the cutting device severs the webbing of the web of pre-inflated pillows.

36. The device of claim 35, wherein the control unit and the motor are further configured to reverse a direction of rotation of the hub upon, or after the cutting device severs the webbing of the web of packaging articles so that contact between a leading edge of the web of packaging articles and the cutting device is minimized.

37. A device for dispensing pillows for product packaging, each of the cushioning pillows comprising a first portion, and second portions each having a thickness less than a thickness of the first portion, the second portions of adjacent pillows adjoining each other to form a continuous web of the pillows, the web defining peaks coinciding with locations of maximum thickness of the first portions, and valleys located between the peaks, the device comprising:

a holding bin defining an internal volume configured to receive the web of pillows;

a duct defining a channel configured to receive the web of pillows and guide the web of pillows to the internal volume of the holding bin in a first direction;

an air circulating device in fluid communication with the channel and configured to, during operation, direct air into the channel at a pressure and flow-rate sufficient to move the web of pillows through the channel in the first direction; and an anti-reverse feature mounted within the channel and configured to inhibit movement of the web of pillows in a second direction opposite the first direction.

38. The device of claim 37, further comprising a transfer unit comprising a pushing member, the pushing member configured to engage the web of pillows so that the pushing member draws the web of pillows into the transfer unit from the holding bin and advances the web of pillows within the transfer unit and toward an exit of the transfer unit.

39. The device of claim 37, wherein:

the duct is mounted on an external surface of the holding bin; and the duct and the external surface of the holding bin define the channel.

40. The device of claim 39, wherein the anti-reverse feature includes a tab.

41. The device of claim 37, wherein the internal volume of the holding bin has a width about equal to a maximum width of the pillows.

42. The device of claim 37, wherein:

the holding bin includes a first and a second sidewall spaced apart by a distance defining a width of the internal volume of the holding bin; and the pillows within the holding bin are constrained from substantial movement in a widthwise direction of the pillows by the first and second sidewalls.

43. The device of claim 37, wherein the channel has a width about equal to a maximum width of the pillows.

44. The device of claim 37, wherein the channel has a substantially vertical orientation.

45. The device of claim 37, wherein the channel has cross-sectional dimensions about equal to a thickness and a maximum width of the pillows.

46. The device of claim 37, wherein the air circulating device is one of a fan and a blower.

47. The device of claim 37, wherein the bin is configured so that the web of pillows falls toward a bottom of the holding bin and folds upon itself after entering the holding bin.

48. The device of claim 47, wherein the bin is further configured so that the web of pillows folds in a random pattern after entering the holding bin.

49. The device of claim 37, further comprising an inflation and sealing machine positioned relative to the holding bin so that the web of pillows exits the inflation and sealing machine at a point lower than a bottom of the holding bin, the inflating and sealing machine configured to form the web of inflatable pillows and to feed the web into the holding bin.

50. The device of claim 37, further comprising a conveyor positioned below a bottom of the holding bin.

* * * * *